US009549650B2

(12) United States Patent
Ford et al.

(10) Patent No.: US 9,549,650 B2
(45) Date of Patent: Jan. 24, 2017

(54) CLEANING APPLIANCE

(71) Applicant: Dyson Technology Limited, Wiltshire (GB)

(72) Inventors: Matthew William Ford, Malmesbury (GB); Phillip John Chambers, Malmesbury (GB); Neil Ewen Callum MacQueen, Malmesbury (GB); Emily Kaye Pettitt, Malmesbury (GB); Spencer James Robert Arthey, Malmesbury (GB)

(73) Assignee: DYSON TECHNOLOGY LIMITED, Malmesbury, Wiltshire (GB)

( * ) Notice: Subject to any disclaimer, the term of this patent is extended or adjusted under 35 U.S.C. 154(b) by 537 days.

(21) Appl. No.: 13/963,700

(22) Filed: Aug. 9, 2013

(65) Prior Publication Data

US 2014/0041151 A1 Feb. 13, 2014

(30) Foreign Application Priority Data

Aug. 9, 2012 (GB) ..... 1214266.7
Aug. 9, 2012 (GB) ..... 1214268.3
Aug. 9, 2012 (GB) ..... 1214269.1

(51) Int. Cl.
*A47L 9/16* (2006.01)
*A47L 9/12* (2006.01)

(52) U.S. Cl.
CPC ..... *A47L 9/1691* (2013.01); *A47L 9/122* (2013.01); *A47L 9/1666* (2013.01)

(58) Field of Classification Search
CPC .... A47L 9/1683; A47L 9/1608; A47L 9/1666; A47L 9/1691; A47L 9/122; A47L 9/1633; A47L 9/106
See application file for complete search history.

(56) References Cited

U.S. PATENT DOCUMENTS 4,935,984 A * 6/1990 Bryant ..... E03F 7/10 134/167 C
2004/0040270 A1 3/2004 Inoue et al.
(Continued)

FOREIGN PATENT DOCUMENTS

EP 0 042 723 12/1981
EP 2 412 285 2/2012
(Continued)

OTHER PUBLICATIONS

Search Report dated Nov. 21, 2012, directed to GB Application No. 1214269.1; 1 page.
(Continued)

*Primary Examiner* — Robert Scruggs
(74) *Attorney, Agent, or Firm* — Morrison & Foerster LLP

(57) ABSTRACT

A cleaning appliance comprises a cyclonic separating apparatus for separating dust from an airflow, the cyclonic separating apparatus having at least one cyclone, a support structure housing a motor and fan assembly for creating an airflow through the separating apparatus, the cyclonic separating apparatus comprising a duct which directs air from the at least one cyclone towards the support structure, the support structure or duct comprising at least one mesh screen through which air from the cyclonic separating apparatus must pass before reaching the motor and fan assembly.

25 Claims, 24 Drawing Sheets

(56) References Cited

U.S. PATENT DOCUMENTS

| | | | | |
|---|---|---|---|---|
| 2007/0056135 | A1 | 3/2007 | Sasaki et al. | |
| 2007/0186372 | A1* | 8/2007 | Rowntree | A47L 9/127 15/347 |
| 2010/0242208 | A1* | 9/2010 | Gammack | A47L 5/362 15/327.1 |
| 2011/0088211 | A1* | 4/2011 | Dyson | A47L 5/32 15/410 |

FOREIGN PATENT DOCUMENTS

| | | |
|---|---|---|
| GB | 2474462 | 4/2011 |
| WO | WO-2012/119226 | 9/2012 |

OTHER PUBLICATIONS

Search Report dated Nov. 21, 2012, directed to GB Application No. 1214266.7; 1 page.
Search Report dated Nov. 21, 2012, directed to GB Application No. 1214268.3; 1 page.

* cited by examiner

CLEANING APPLIANCE

REFERENCE TO RELATED APPLICATIONS

This application claims the priority of United Kingdom Application No. 1214266.7, filed Aug. 9, 2012, United Kingdom Application No. 1214268.3, filed Aug. 9, 2012, and United Kingdom Application No. 1214269.1, filed Aug. 9, 2012, the entire contents of which are incorporated herein by reference.

FIELD OF THE INVENTION

The invention relates to a cleaning appliance and in particular to a vacuum cleaner.

BACKGROUND OF THE INVENTION

Vacuum cleaners are required to separate dirt and dust from an airflow. Dirt and dust-laden air is sucked into the appliance via either a floor-engaging cleaner head or a tool connected to the end of a hose and wand assembly. The dirty air passes to some kind of separating apparatus which attempts to separate dirt and dust from the airflow. Many vacuum cleaners suck or blow the dirty air through a porous bag so that the dirt and dust is retained in the bag whilst cleaned air is exhausted to the atmosphere. In other vacuum cleaners, cyclonic or centrifugal separators are used to spin dirt and dust from the airflow (see, for example, EP0042723). Whichever type of separator is employed, there is commonly a risk of a small amount of dust passing through the separator and being carried to the fan and motor unit, which is used to create the flow of air through the vacuum cleaner whilst it is in operation.

In view of this, it is common for a filter to be positioned after the separating apparatus and before the motor. Such a filter is often called a 'pre motor' filter.

It would however be desirable to remove this pre-motor filter if possible such that the cost of producing the separating appliance is reduced and also so that a user does not have to maintain the pre-motor filter in any way. During use of a separating appliance such a pre-motor filter can get loaded with dust. If a user does not maintain the filter to remove this build up then it could affect the performance of the cleaning appliance.

In addition, it is very important for correct functioning of a vacuum cleaner to ensure that the separating apparatus is docked correctly with the remainder of the vacuum cleaner and to ensure that dust and dirt particles do not affect the performance of the motor and fan assembly which generate airflow through the vacuum cleaner.

The present invention seeks to provide an improved cleaning appliance.

SUMMARY OF THE INVENTION

According to a first aspect of the present invention there is provided a cleaning appliance comprising a cyclonic separating apparatus for separating dust from an airflow, the cyclonic separating apparatus having at least one cyclone, a support structure housing a motor and fan assembly for creating an airflow through the separating apparatus, the cyclonic separating apparatus comprising a duct which directs air from the at least one cyclone towards the support structure, the support structure or duct further comprising at least one mesh screen through which air from the cyclonic separating apparatus must pass before reaching the motor and fan assembly.

Having a mesh screen between the cyclonic separating apparatus and the motor may advantageously allow the cleaning appliance to be constructed without a pre motor filter. Preferably the mesh screen is connected to the support structure.

The mesh screen may be formed from woven stainless steel threads however it may alternatively be formed from any other suitable metal or plastics material. The mesh preferably has apertures of from less than 1 micron to 2.2 mm Most preferably the mesh has apertures of from 0.14 mm to 0.16 mm and most preferably from 0.14 mm to 0.155 mm Such a mesh may advantageously prevent particles which are from 140 to 155 microns from passing through it.

What size of mesh aperture to choose will depend on the dimensions of components of the motor and fan and will depend on what type and size of dirt particle the motor and fan assembly can handle without damage.

The mesh screen is preferably a woven screen but may instead be formed by other manufacturing methods, for example by stamping apertures into a sheet of material. In a preferred embodiment the open area of the mesh screen is from 40% to 65%. Ideally the open area of the mesh screen is at least the same area as the area of the inlet of the motor.

In a particular embodiment there may be a plurality of mesh screens.

The cleaning appliance may also further comprise a spigot which may project from the support structure and which, in use, docks within the duct. The spigot may have at least one groove and the duct may have at least one corresponding projection. The cleaning appliance is preferably arranged such that when the cyclonic separating apparatus is docked on the support structure, the projection is located within the groove.

This may be advantageous as these features can help to ensure that the cyclonic separating apparatus is correctly docked on the support structure thus helping to ensure that there are no air leaks in the system.

In a particular embodiment the spigot may comprises a pair of opposed grooves and the duct may comprises a pair of opposed projections. The projections may be in the form of fins. The projections may have a pair of opposed running surfaces which are parallel to one another. The grooves may have a corresponding pair of angled running surfaces which may also be parallel to each other. In a preferred embodiment the angled running surfaces may be at a 10 to 30 degree angle to the longitudinal axis of the spigot. In a preferred embodiment the angled running surfaces may be at a 19 degree angle to the longitudinal axis of the spigot.

During docking of the separating apparatus, the projections preferably engage within the grooves such that the opposed running surfaces of the projections come into contact with and run along the angled running surfaces of the grooves. This may help to ensure that the separating apparatus is docked onto the spigot correctly and at the desired angle. In a preferred embodiment, once the separating apparatus is fully docked on the spigot, the opposed running surfaces contact parallel docking surfaces of the grooves. The parallel docking surfaces are preferably positioned below the angled running surfaces. These parallel docking surfaces may also be parallel with the longitudinal axis of the spigot. This may advantageously help to ensure that the longitudinal axis of the separating apparatus and the spigot are in line once the separating apparatus is fully docked on the spigot.

The spigot may have a side surface and a top surface. Preferably the spigot has at least one aperture through which air can pass. The top surface of the spigot may be closed such that it is impermeable to airflow. A closed top surface may be advantageous as it may allow better control of the flow of dirt and dust particles towards the motor and fan unit. The groove(s) are most preferably located on the side surface of the spigot. They may however open out onto the top surface of the spigot.

The spigot may be generally cylindrical in shape although it may be any other suitable shape as long as the shape is such that it can fit into and form a seal with the duct. In a preferred embodiment a portion of the side surface of the spigot curves towards the top surface of the spigot. This curved surface may help to ensure that when the cyclonic separating apparatus is removed from the spigot, that the spigot does not catch on a bin base of the cyclonic separating apparatus which might otherwise cause the bin base to undesirably open. The spigot is preferably elongate in that it is taller in height than it is wide and its widest point.

In a particular embodiment the side surface of the spigot comprises at least one of the mesh screens through which air from the cyclonic separating apparatus must pass before reaching the motor and fan assembly. Ideally a plurality of mesh screens are located on the spigot.

The cyclonic separating apparatus may also further comprises a cleaner for cleaning the at least one screen. The cleaner may comprise a sweeping member located in the duct. In a preferred embodiment the cleaning member is arranged such that it sweeps across the at least one screen as the cyclonic separating apparatus is docked onto the spigot and/or undocked from the spigot. The cleaner may be circular in shape and is preferably located such that it projects into the duct to form a ring shaped cleaner. In a preferred embodiment the cleaner is fixed against rotational movement. In a preferred embodiment the cleaner may be fixed against vertical or horizontal movement. The cleaner may however be able to move laterally to some extent.

In a preferred embodiment the cleaner may comprise a brush, for example a brush formed from a plastics material such as nylon.

In a particular embodiment the support structure may be a rolling support structure for allowing the cleaning appliance to be maneuvered across a surface to be cleaned.

BRIEF DESCRIPTION OF THE DRAWINGS

Embodiments of the invention will now be described with reference to the accompanying drawings in which.

DETAILED DESCRIPTION OF THE INVENTION

Figure 1:
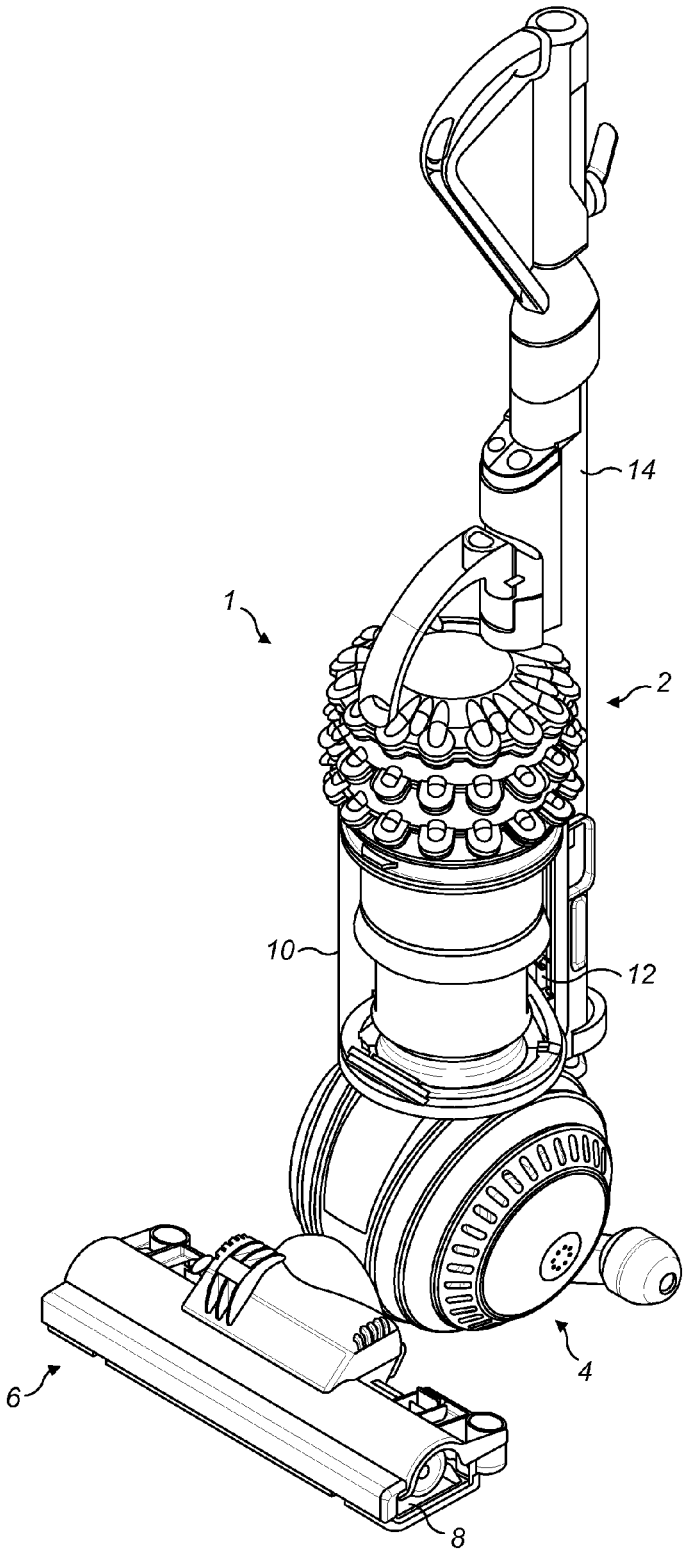
FIG. 1 is a front perspective view, from above, of a vacuum cleaner.

In FIG. 1 the surface treating appliance is a vacuum cleaner as indicated generally by the reference numeral 1.

The vacuum cleaner 1 can be seen to comprise a main body 2 and a rolling support structure 4 mounted on the main body 2 for manoeuvring the vacuum cleaner 1 across a surface to be cleaned. A cleaner head 6 is pivotably mounted on the lower end of the rolling support structure 4 and an appliance dirty air inlet 8 is provided on the underside of the cleaner head 6 facing the surface to be cleaned. A separating apparatus 10 is removably provided on the main body 2 and ducting 12 provides communication between the dirty air inlet 8 and the separating apparatus 10. A wand and handle assembly 14 is releasably mounted on the main body 2 behind the separating apparatus 10.

Figure 2A:
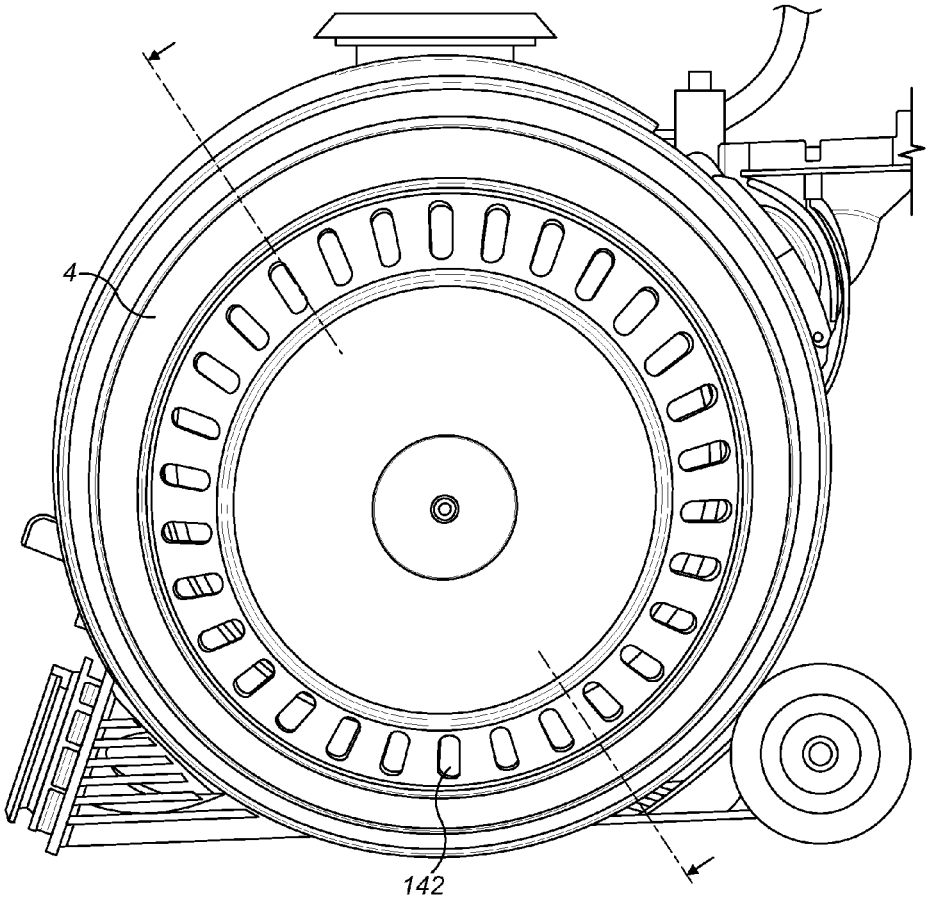
FIG. 2A is a side view of the rolling support structure shown in FIG. 1.
Figure 2B:
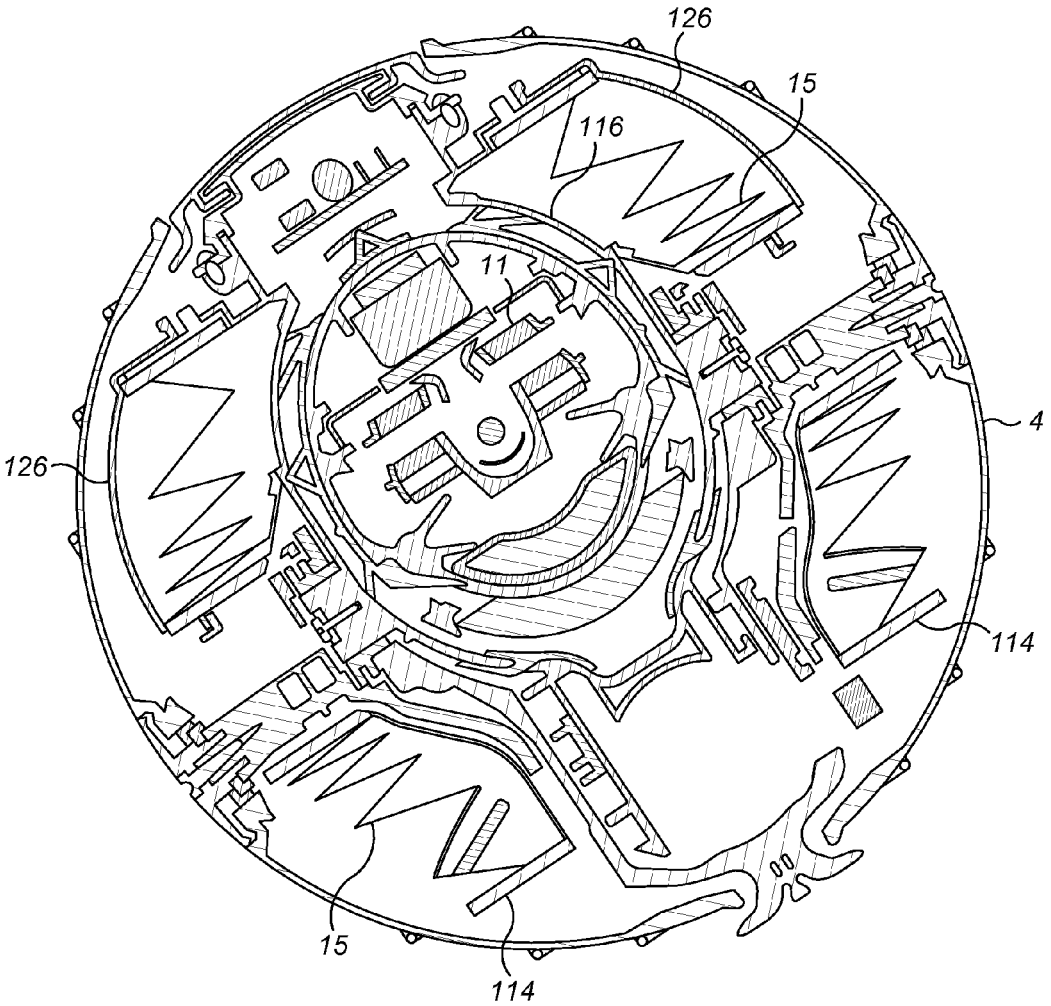
FIG. 2B is a section through the rolling support structure shown in FIG. 2A.
Figure 3:
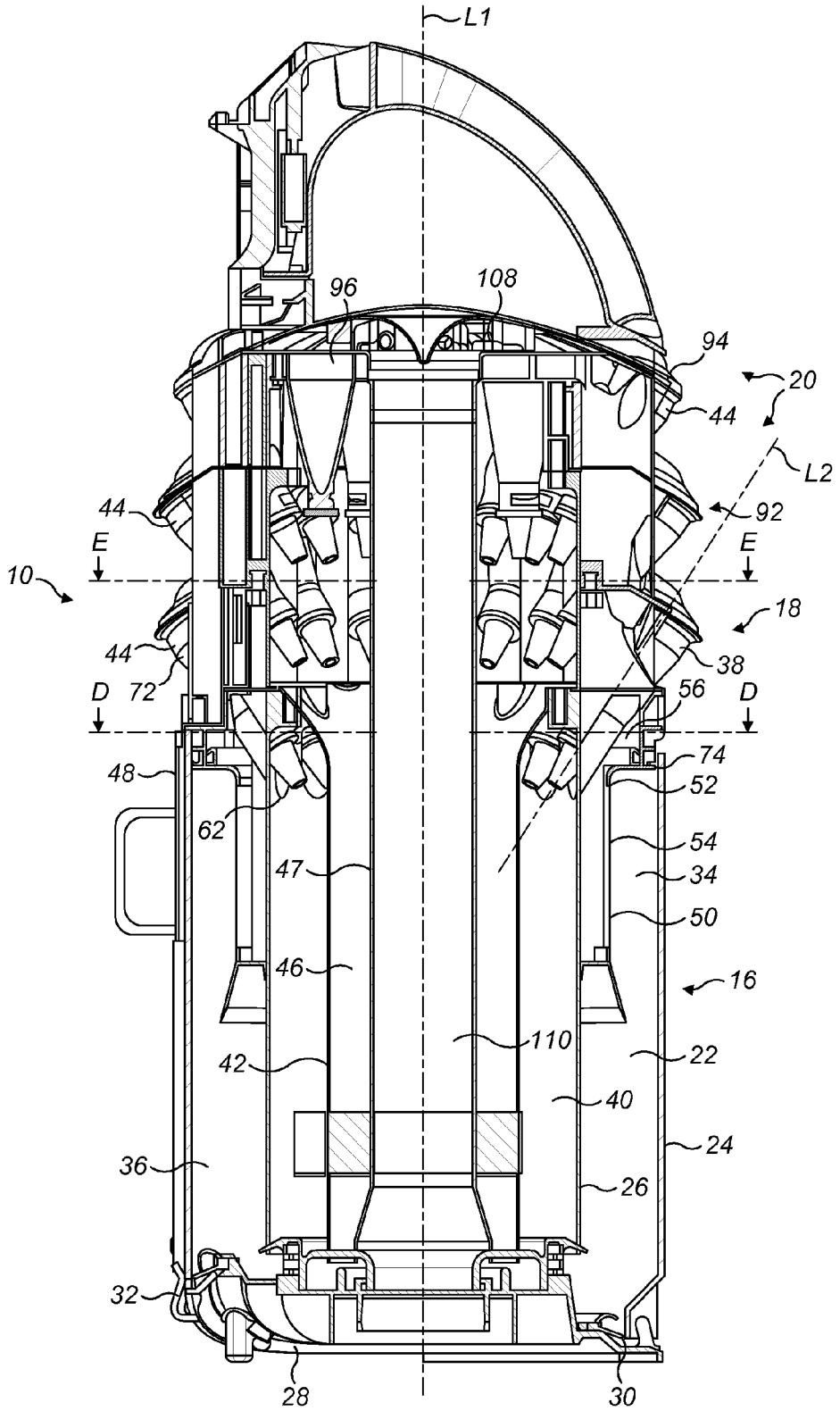
FIG. 3 is a section through the separating apparatus shown in FIG. 1.

In use, a motor and fan unit 11 shown in FIG. 2*b* which is located inside the rolling support structure 4 draws dust laden air into the vacuum cleaner 1 via either the appliance dirty air inlet 8 or the wand 14. The dust laden air is carried to the separating apparatus 10 via the ducting 12 and the entrained dust particles are separated from the air and retained in the separating apparatus 10. The cleaned air passes through the motor 11 and is then ejected from the vacuum cleaner 1 via the post motor filters 15. The air then exits the rolling support 4 via the apertures 142 shown in FIG. 2*b*.

One embodiment of the separating apparatus 10 forming part of each of the vacuum cleaners 1 is shown in more detail in FIGS. 3 to 11. The specific overall shape of the separating apparatus 10 can be varied according to the type of vacuum cleaner 1 in which the separating apparatus 10 is to be used. For example, the overall length of the separating apparatus 10 can be increased or decreased with respect to the diameter of the separating apparatus 10.

The separating apparatus 10 can be seen to have a first cyclonic separating unit 16, a second cyclonic separating unit 18 and a third cyclonic separating unit 20.

The first cyclonic separating unit 16 can be seen to be the annular chamber 22 located between the outer wall 24 which is substantially cylindrical in shape and the first inner wall 26 which is also substantially cylindrical in shape. The first inner wall 26 is located radially inwardly from the outer wall 24 and is spaced from it. The lower end of the separating apparatus 10 is closed by a base 28 which is pivotably attached to the outer wall 24 by means of a pivot 30 and held in a closed position by a catch 32.

The top portion of the annular chamber 22 forms a low efficiency cylindrical cyclone 34 of the first cyclonic separating unit 16 and the lower portion forms a first dust collecting bin 36.

The second cyclonic separating unit 18 comprises a plurality of second cyclones 38, which are arranged in parallel in terms of airflow through the cyclones 38, and a second dust collecting chamber 40. The second dust collecting chamber 40 is formed between the first inner wall 26 and a second inner wall 42 which is substantially cylindrical in shape. The second inner wall 42 is located radially inwardly from the first inner wall 26 and is spaced from it.

The third cyclonic separating unit 20 comprises a plurality of third cyclones 44, which are arranged in parallel in terms of airflow through the cyclones 44, and a third dust collecting chamber 46. The third dust collecting chamber 46 is bounded by the second inner wall 42 and a third inner wall 47 which is substantially cylindrical in shape. The third inner wall 47 is located radially inwardly from the second inner wall 42 and is spaced from it.

In the closed position, the base 28 is sealed against the lower ends of the walls 24, 26, 42, 47. Releasing the catch 32 allows the base 28 to pivot away from walls 24, 26, 42, 47 for emptying the first, second and third dust collecting chambers 36, 40, 46 simultaneously. The first, second and third dust collecting chambers 36, 40, 46 are all substantially annular in shape.

A dust laden air inlet 48 is provided in the outer wall 24 of the first cyclonic separating unit 16. The dust laden air inlet 48 is arranged tangentially to the outer wall 24 so as to ensure that incoming dust laden air is forced to follow a helical path around the low efficiency cyclone 34. A fluid outlet from the first cyclonic separating unit 16 is provided in the form of a shroud 50. The shroud 50 comprises a cylindrical wall 52 in which a large number of perforations 54 are formed. The only fluid outlet from the first cyclonic separating unit 16 is formed by the perforations 54 in the shroud 50.

A first plenum chamber 56 is formed downstream of the shroud 50. The plenum chamber 56 communicates with the second cyclones 38 of the second cyclonic separating unit 18. This first plenum chamber 56 can be seen best in FIG. 4 which is a top sectional view of the separating apparatus 10 taken along plane D-D of FIG. 3.

As stated above, the second cyclonic separating unit 18 comprises a plurality of second cyclones 38, in this embodiment there are 14 second cyclones 38. The second cyclonic separating unit 18 is located downstream from the first cyclonic separating unit 16. Each second cyclone 38 is identical to the other second cyclones 38. The second cyclones 38 are arranged in a ring which is centred on the longitudinal axis L1 of the first cyclonic separating unit 16. Each second cyclone 38 has an axis L2 which is inclined downwardly and inwardly towards the axis L1 of the first cyclonic separating unit 16. The orientation of the second cyclones 38 to the longitudinal axis L1 is such that the low efficiency cyclone 34 extends about a lower part of each of the second cyclones 38, whereas an upper part of each of the second cyclones 38 is located above the low efficiency cyclone 34.

Figure 5:
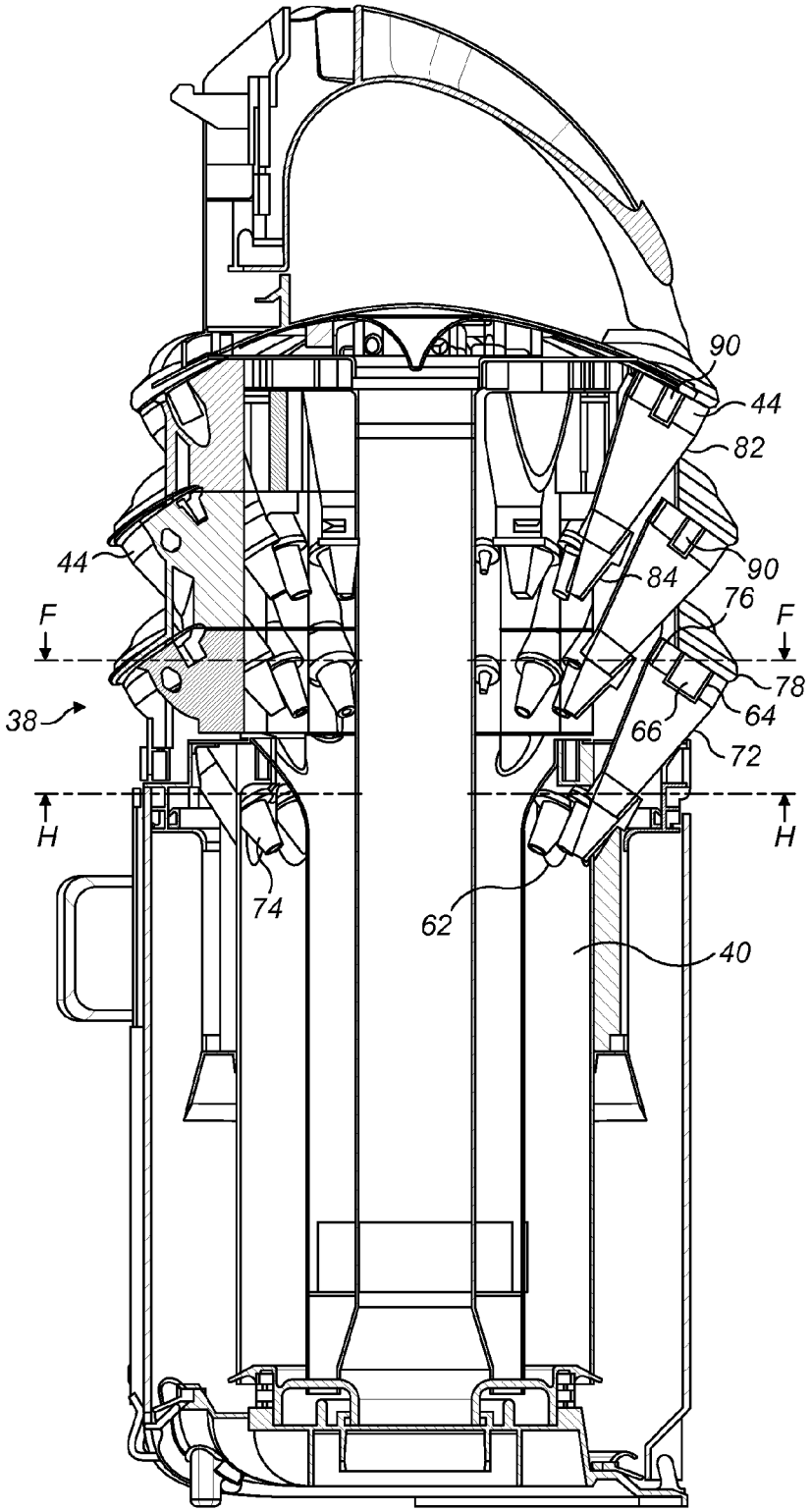
FIG. 5 is a section through the separating apparatus shown in FIG. 1.
Figure 6:
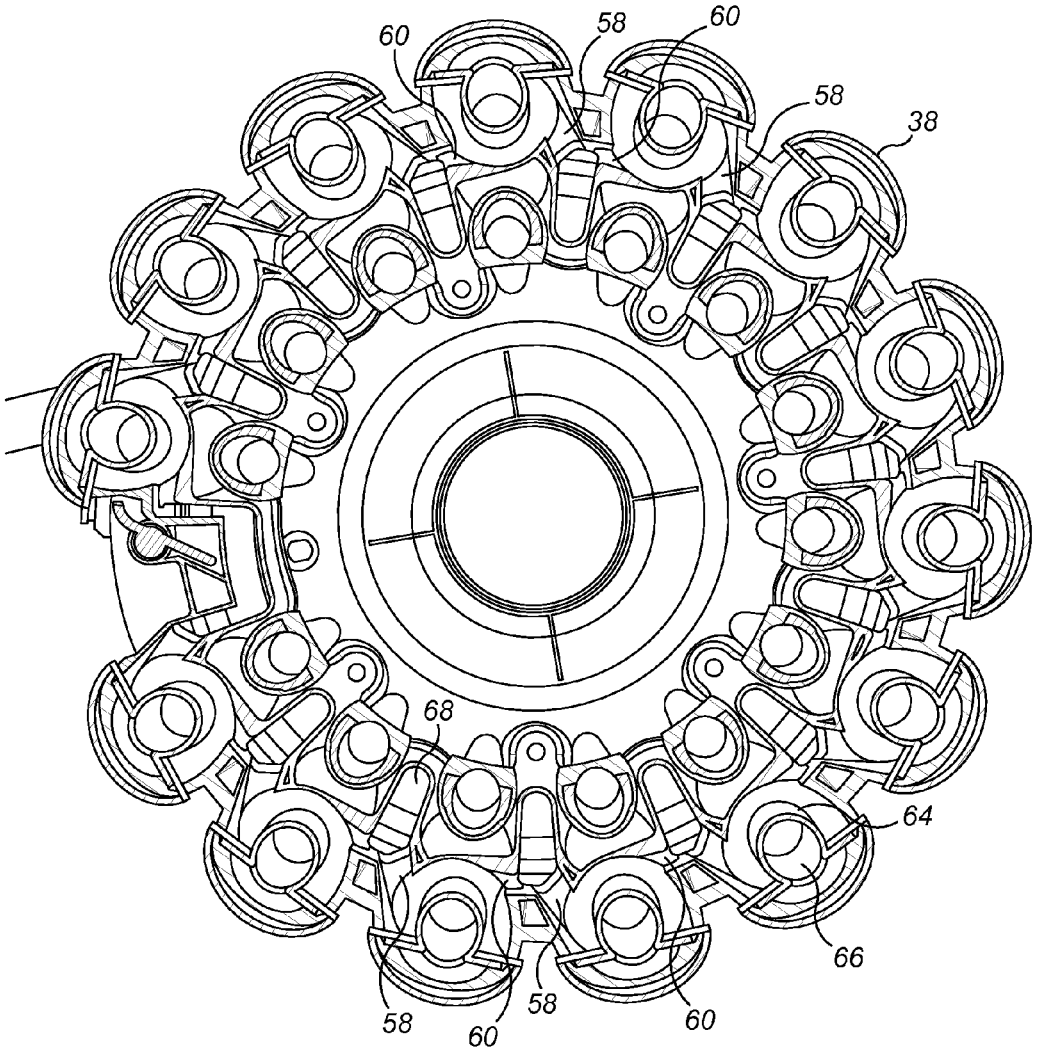
FIG. 6 is a top sectional view of the separating apparatus taken along plane F-F of FIG. 5.
Figure 7:
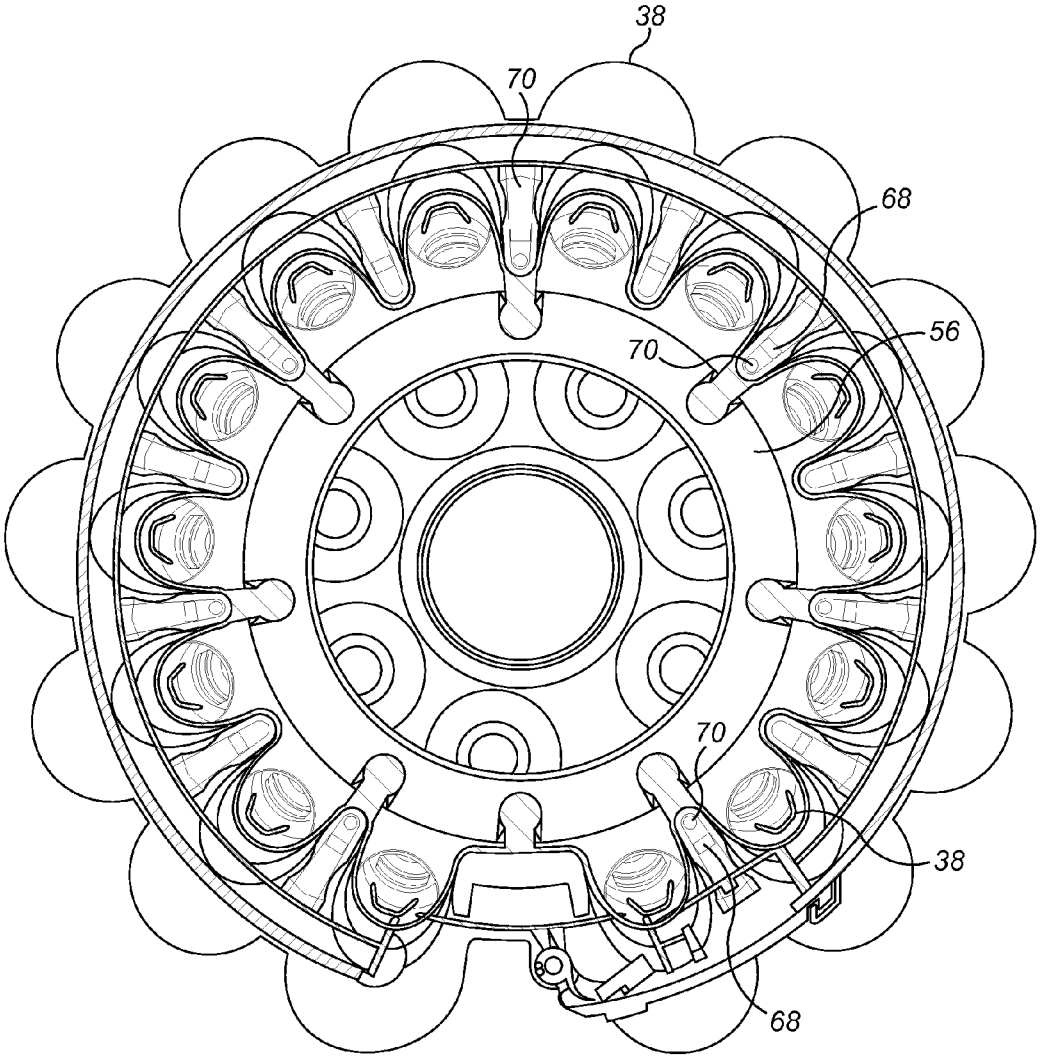
FIG. 7 is an underneath sectional view of the separating apparatus taken along plane H-H of FIG. 5.

Each second cyclone 38 has a cylindrical upper section and a tapering body section which is preferably frusto-conical in shape. Each secondary cyclone 38 comprises a dirt outlet 62 which opens into the top of the second dust collecting chamber 40. In use dust separated by the second cyclones 38 will exit through the dirt outlets 62 and will be collected in the second dust collecting chamber 40. A vortex finder 64, which can be best seen in FIG. 5 is provided at the upper end of each second cyclone 38. The vortex finders 64 provide air outlets 66 from the second cyclones 38. Each second cyclone 38 comprises a first inlet 58 and a second inlet 60. These inlets can be best seen in FIG. 6 which is a top sectional view of the separating apparatus 10 taken along plane F-F of FIG. 5.

The vortex finders 64 are located in a first annular vortex finder plate 76 which covers the open upper ends of the second cyclones 38. A sealing member 78 forms an air tight seal to prevent air from leaking between the second cyclones 38 and the first vortex finder plate 76.

Figure 4:
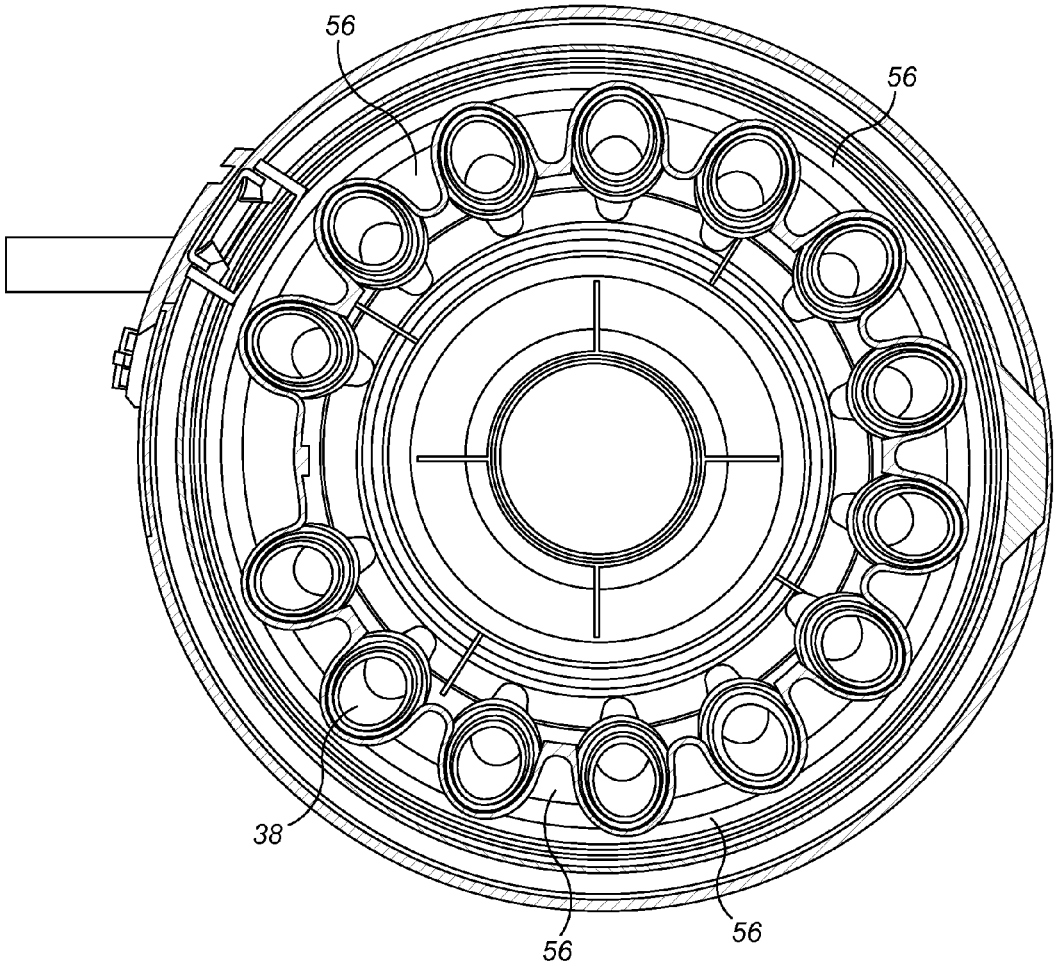
FIG. 4 is a top sectional view of the separating apparatus taken along plane D-D of FIG. 3.

As can be seen in FIG. 4, the first plenum chamber 56 comprises a substantially annular chamber which receives air which has passed through the shroud 50 from the low efficiency cyclone 34. The first plenum chamber 56 further comprises a plurality of first plenum outlets 68 which can be best seen in FIGS. 6 and 7 and which extend from an upper surface of the first plenum chamber 56. Each first plenum outlet 68 is fluidly connected to the inlets 58, 60 of two second cyclones 38. For each second cyclone 38, this means that each first inlet 58 is connected to a different first plenum outlet 68 than each second inlet 60. In the embodiment shown in FIG. 6 where there are 14 second cyclones 38, this means that there are 14 first plenum outlets 68 which feed air to be cleaned into all 14 of the second cyclones 38.

It can be seen that the inlets 58, 60 of the second cyclones 38 are arranged in an annular arrangement. Each first plenum outlet 68 is therefore fluidly connected to the inlets 58, 60 of two adjacent second cyclones 38. The first plenum outlets 68 are in the form of elongate airways, such that they are elongate in cross section. A portion 70 of each first plenum outlet 68 is located between two adjacent second cyclones 38 leading from the first plenum chamber 56 up to the inlets 58, 60 of the second cyclones 38. This can be best seen best in FIG. 7 which is an underneath sectional view of the separating apparatus 10 taken along plane H-H of FIG. 5. The first plenum outlets 68 are therefore contained internally within the separating apparatus 10 and are not therefore visible on any external surface of the cyclonic separating apparatus 10.

In the embodiments shown it can be seen that the body section of the second cyclones 38 is divided into a rigid upper portion 72 and a lower flexible tip 74. It has been found that the flexible tips 74 vibrate as airflow passes through the second cyclones 38 during use of the vacuum cleaner 1. This vibration has been found to help prevent a build up of dirt within the second cyclones 38.

The flexible tips 74 are preferably less than one third of the total length of the second cyclones 38. The flexible tips 74 are over-moulded on to the rigid portions 72. Alternatively, the flexible tips 74 may be glued, fixed or clamped to the rigid upper portion 72 by any suitable method or by using any suitable fixing means. Whichever technique is used to connect the flexible tip 74 to the rigid upper portion 72, the connection is preferably such that there is no significant step or other discontinuity on the inner surface of the body section at the joint between the rigid upper portion 72 and the flexible tip 74. The flexible tip 74 is preferably formed from a rubber material, which may have a Shore A value of around 20, whereas the rigid upper portion 72 is preferably formed from polypropylene, which may have a shore D value of around 60.

As mentioned above, a third cyclonic separating unit 20 is located downstream from the second cyclonic separating unit 18. The third cyclonic separating unit 20 comprises a plurality of third cyclones 44 arranged in parallel. In this embodiment, the third cyclonic separating unit 20 comprises thirty five third cyclones 44. Each third cyclone 44 is identical in size and shape to the other third cyclones 44. In this embodiment, each third cyclone 44 is also substantially the same as each of the second cyclones 38. However, the third cyclones 44 may be a different size to the second cyclones 38.

As with the second cyclones 38, each third cyclone 44 has a cylindrical upper section and a tapering body section which is preferably frusto-conical in shape. The body section is divided into a rigid upper portion 82 and a flexible tip 84. The rigid upper portions 82 and the flexible tips 84 of the third cyclones 44 are each preferably formed from the same material and in the same manner as the relevant portions of the second cyclones 38. Each third cyclone 44 has a single fluid inlet 86 and a single fluid outlet 90. For each third cyclone 44, the fluid inlet 86 is located in an upper section of the third cyclone 44, and is arranged so that air enters the third cyclone 44 tangentially. The fluid outlet 90 is in the form of a vortex finder 88 which is provided at the upper end of each third cyclone 44.

To reduce the diameter of the separating apparatus 10, the third cyclones 44 are arranged in a plurality of sets. In this embodiment, the third cyclonic separating unit 20 comprises a first set of third cyclones 92, a second set of third cyclones 94, and a third set of third cyclones 96. The first and second sets 92, 94 contain the same number of third cyclones 44 and the third set 96 contains a lower number of third cyclones 44. In this embodiment there are 14 third cyclones 44 in the first and second sets 92, 94 and 7 third cyclones 44 in the third set 96.

Figure 8:
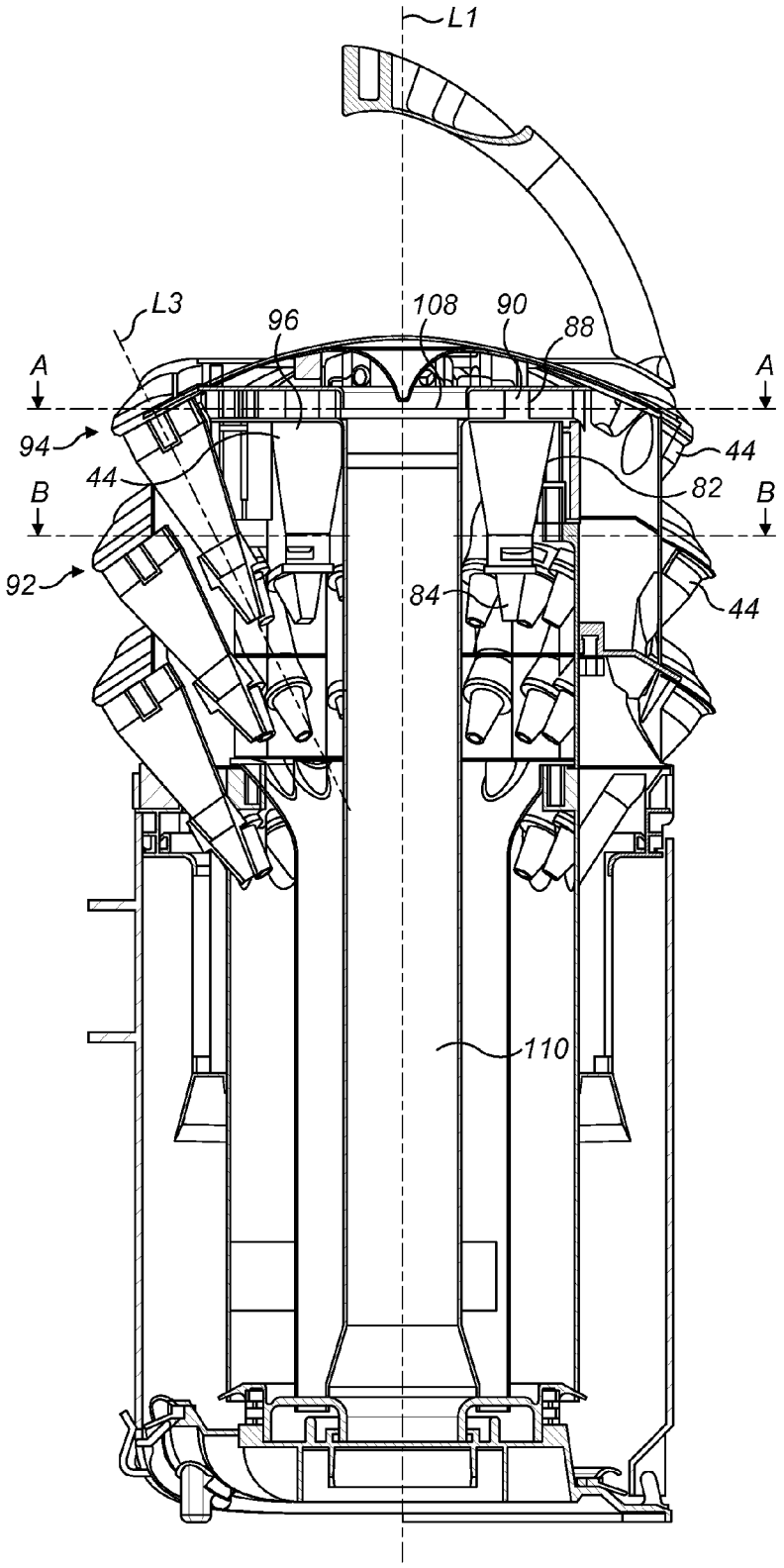
FIG. 8 is a section through the separating apparatus shown in FIG. 1.
Figure 9:
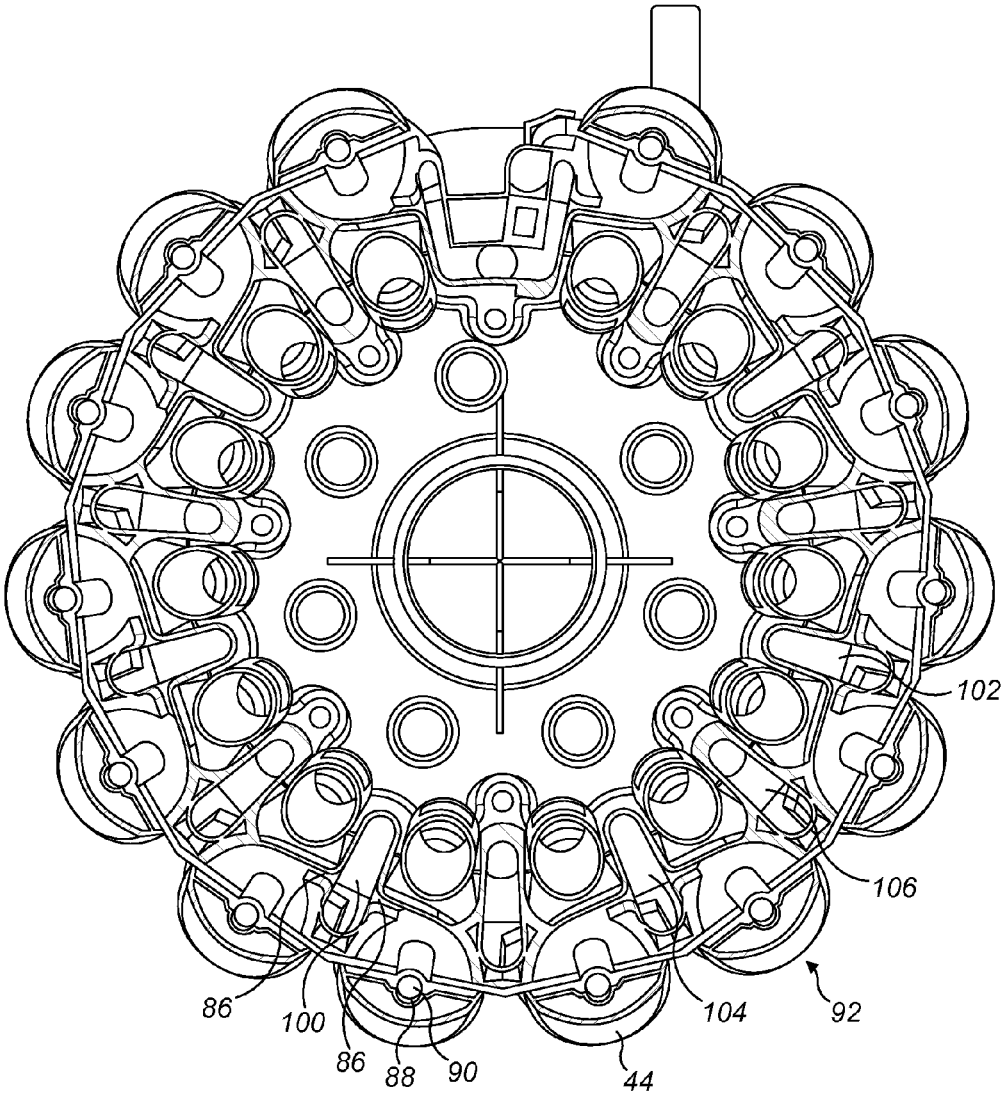
FIG. 9 is a top sectional view of the separating apparatus taken along plane B-B of FIG. 8.
Figure 10:
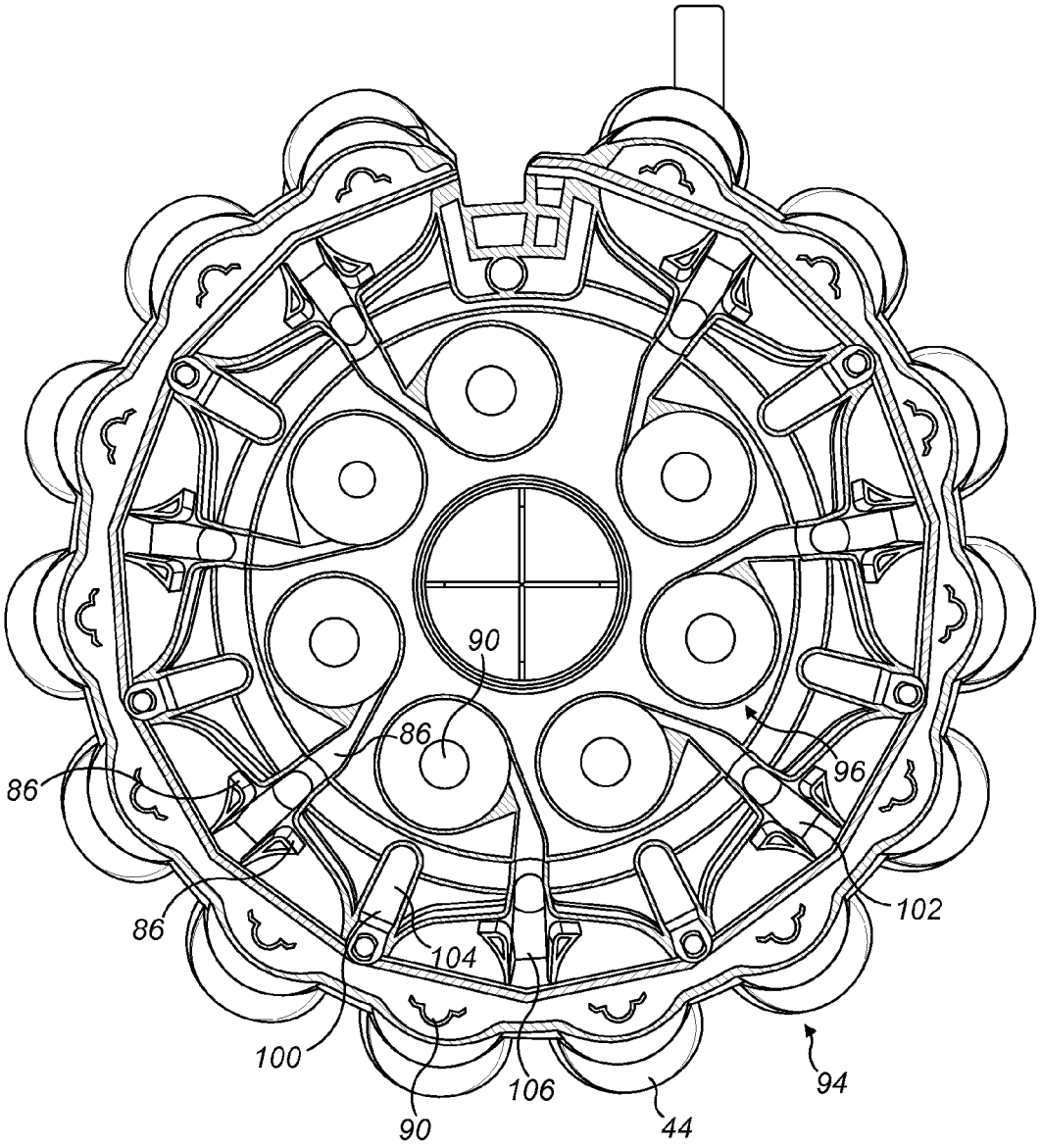
FIG. 10 is a top sectional view of the separating apparatus taken along plane A-A of FIG. 8.
Figure 11:
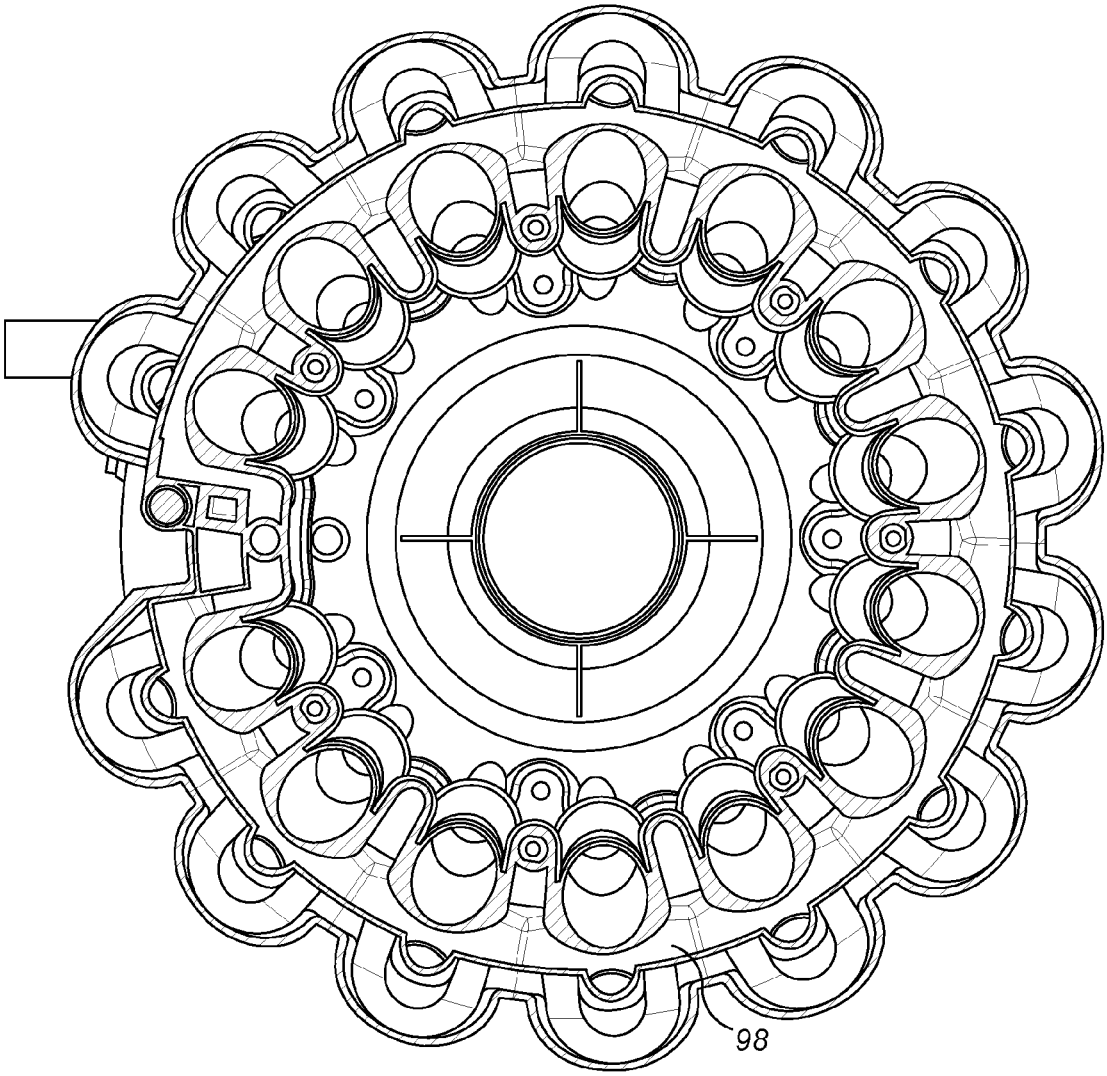
FIG. 11 is a top sectional view of the separating apparatus taken along plane E-E in FIG. 3.

FIG. 9 is a top sectional view of the separating apparatus 10 taken along plane B-B passing through the fluid inlets 86 of the first set of third cyclones 92, and FIG. 10 is a top sectional view of the separating apparatus 10 taken along plane A-A passing through the fluid inlets of the second and third sets of third cyclones 94, 96. As illustrated in FIG. 8, each of these planes is substantially orthogonal to the longitudinal axis L1. The planes A-A and B-B are spaced along the longitudinal axis L1, with plane A-A located above plane B-B.

The first set of third cyclones 92 is located above the second cyclones 38. The second set of third cyclones 94 is located above the first set of third cyclones 92. In this respect the second cyclones 38 and the first and second sets 92, 94 of third cyclones 44 are stacked. In this example, the arrangement of the third cyclones 44 within the first and second sets 92, 94 of third cyclones 44 is substantially the same as the arrangement of the second cyclones 38. In this respect, the third cyclones 44 in the first and second sets 92, 94 are arranged in a generally frusto-conical arrangement which extends about, and is centred on, the longitudinal axis L1. Within this arrangement, the third cyclones 44 in each of the first and second sets 92, 94 are equidistantly spaced from the longitudinal axis L1, and are generally equi-angularly spaced about the longitudinal axis L1. The radial spacing of the third cyclones 44 in the first and second sets 92, 94, from the longitudinal axis L1, is substantially the same as the radial spacing of the second cyclones 38 from the longitudinal axis L1.

The first and second sets of third cyclones 92, 94 are also arranged at the same orientation to the longitudinal axis L1 as the second cyclones 38. Each cyclone of the first and second sets 92, 94 of third cyclones 44 has a longitudinal axis L3, and the cyclones 44 are arranged so that their longitudinal axes L3 approach one another, and intersect the longitudinal axis L1.

Each third cyclone 44 of the first set of third cyclones 92 is located immediately above a respective one of the second cyclones 38. To minimise the increase in the height of the separating apparatus 10, the first set of third cyclones 92 is arranged so that an upper portion of the second cyclones 38 extends about, or overlaps, a lower portion of the first set of third cyclones 92.

Each third cyclone 44 of the second set of third cyclones 94 is located immediately above a respective one of the third cyclones 44 of the first set of third cyclones 92. Again to minimise the increase in the height of the separating apparatus 10 the second set of third cyclones 94 is arranged so that an upper portion of the first set of third cyclone 92 extends about, or overlaps a lower portion of the second set of third cyclones 94.

The arrangement of the first and second sets of third cyclones 92, 94 is such that the fluid inlets 86 of the first set of third cyclones 92 are arranged in a first group, and the fluid inlets 86 of the second set of third cyclones 94 are arranged in a second group which is spaced along the longitudinal axis L1 from the first group. Within each group, the fluid inlets 86 are generally arranged in an annular arrangement about the longitudinal axis L1, with the annular arrangement being substantially orthogonal to the longitudinal axis L1.

The cyclones of the third set of third cyclones 96 are also arranged in a generally annular arrangement which extends about, and is centred on, the longitudinal axis L1. Within this arrangement, the third cyclones are equidistantly spaced from the longitudinal axis L1, and are equi-angularly spaced about the longitudinal axis L1, but the radial spacing of the third cyclones from the longitudinal axis L1 is smaller than that of the cyclones of the first and second sets of third cyclones 92, 94.

To maximise the number of cyclones within the third set of third cyclones 96, the third set of third cyclones 96 is arranged at a different orientation to the second set of third cyclones 94. Within this third set the cyclones 44 are arranged such that they are parallel to the longitudinal axis L1.

The third set of third cyclones 96 is also located on the same plane as the second set of third cyclones 94 such that the second set of third cyclones 94 extends around the third set of third cyclones 96.

The arrangement of the third set of third cyclones 96 is such that the fluid inlets 86 of the third set of third cyclones 96 are arranged in line with the fluid inlets 86 of the second set of third cyclones 94. Within this third set 96, the fluid inlets 86 are generally arranged in an annular arrangement about the longitudinal axis L1, with the annular arrangement being substantially orthogonal to the longitudinal axis L1.

Air is conveyed from the second cyclonic separating unit 18 to the third cyclonic separating unit 20 via a second plenum chamber 98. The second plenum chamber 98 is a substantially annular chamber which receives air from the air outlets 66 of all of the second cyclones 38. The second plenum chamber 98 can be seen best in FIG. 11 which shows a top sectional view of the separating apparatus 10 taken along plane E-E in FIG. 3.

The second plenum chamber 98 further comprises a plurality of second plenum outlets 100 which can be best seen in FIGS. 9 and 10 and which extend from an upper surface of the second plenum chamber 98. Each second plenum outlet 100 is fluidly connected to the inlets 86 of at least two third cyclones 44.

The second plenum outlets 100 are in the form of elongate airways, such that they are elongate in cross section. A portion 102 of each second plenum outlet 100 is located between two adjacent cyclones 44 in the first set of third cyclones 92 leading from the second plenum chamber 98 up to the inlets 86 of the third cyclones. The second plenum outlets 100 are therefore contained internally within the separating apparatus 10 and are not therefore visible on any external surface of the cyclonic separating apparatus 10.

The arrangement of second plenum outlets 100 is more complex than the arrangement of first plenum outlets 68 because the third cyclonic separating unit 20 is arranged in three sets 92, 94, 96 of third cyclones 44. In the embodiment shown half of the second plenum outlets 100 feed the third cyclones in the first set of third cyclones 92 and half of the second plenum outlets 100 feed the second and third sets 94, 96 of third cyclones 44.

The plurality of second plenum outlets 100 are therefore divided into a first set of second plenum outlets 104 and a second set of second plenum outlets 106. Each second plenum outlet 100 of the first set of second plenum outlets 104 is fluidly connected to the inlets 86 of two third cyclones 44 in the first set of third cyclones 92. Each second plenum outlet 100 in the second set of second plenum outlets 106 passes the first set of third cyclones 92 and is fluidly connected to the inlets 86 of two third cyclones 44 in the second set of third cyclones 94 and one inlet 86 in the third set of third cyclones 96.

As stated above in order to reach the respective third cyclone 44 at least a portion 102 of each first and second plenum outlet 104, 106 is located between two adjacent cyclones 44 in the first set of third cyclones 92. In addition at least a portion 102 of each of the second set of second plenum outlets 106 is located between two adjacent cyclones in both of the first and second sets of third cyclones 92, 94 such that the second plenum outlets 100 in the second set 106 pass up past the cyclones 44 in the first set of third cyclones 92 and lead air to the inlets of the second and third sets of third cyclones 94.

The first and second plenum outlets 104, 106 alternate in an annular arrangement about the axis L1.

Once air has been cleaned by the third cyclonic separating unit 20 it leaves the third cyclones 44 via the vortex finders 88. This air then travels through an exhaust manifold 108 and then into a down duct 110 which directs cleaned air down through the centre of the separating apparatus 10 towards the motor and fan unit 11 contained within the rolling support structure 4.

Figure 12:
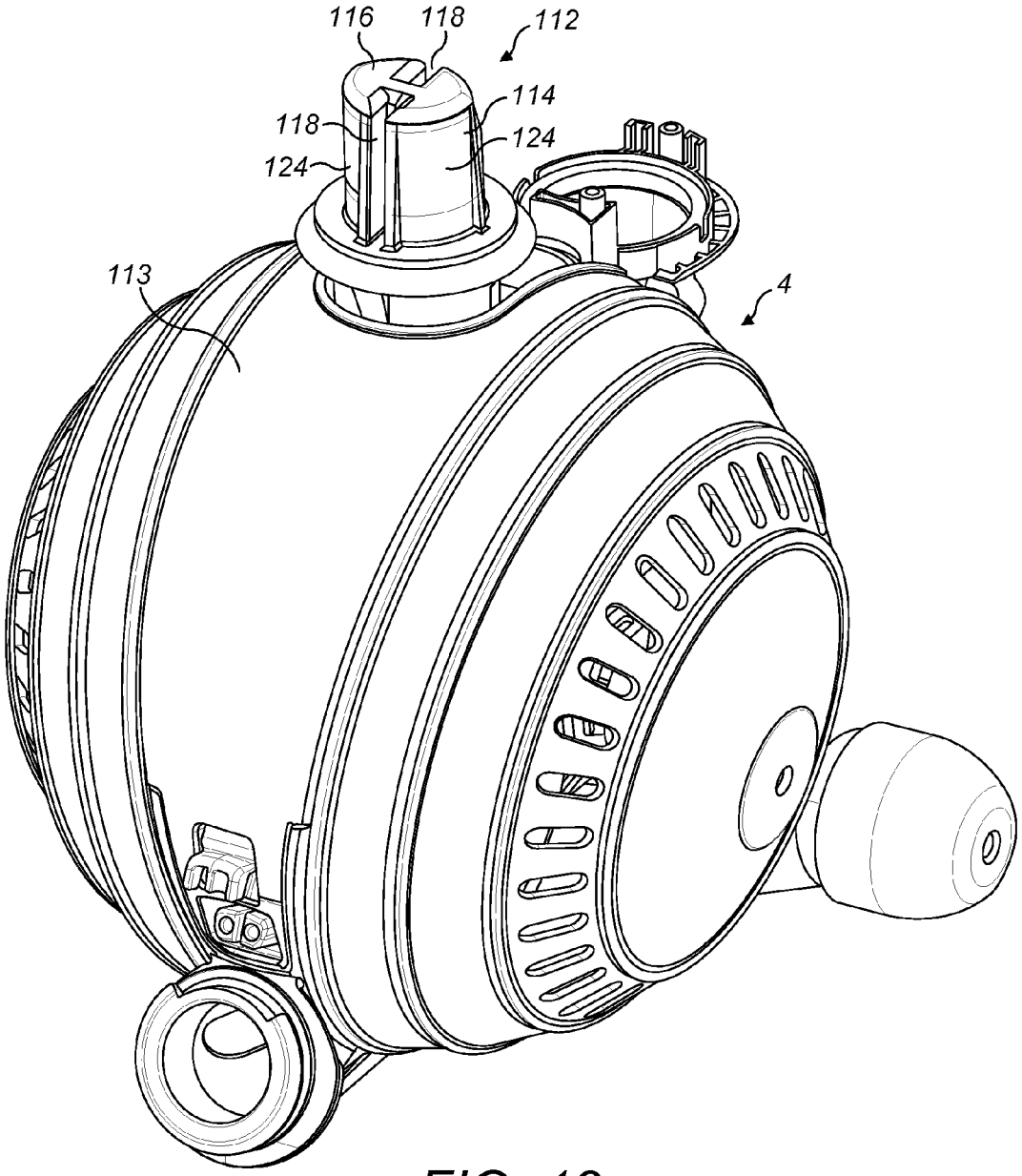
FIG. 12 is a perspective view of the rolling support structure of a second embodiment of the present invention.

A second embodiment is shown in FIGS. 12 to 20. In these embodiments the cyclone arrangement is the same as in the first embodiment but the vacuum cleaner 1 has some additional features. FIG. 12 shows a perspective view of the rolling support structure 4. It can be seen that this rolling support structure 4 has a spigot 112 which projects from the rolling support structure 4. In use this spigot 112 helps to ensure that the separating apparatus 10 is docked in the correct position on the rolling support structure 4. The spigot 112 can be seen in more detail in FIGS. 13*a* to 13*d*. It can be seen that the spigot 112 has a side surface 114 and a top surface 116. The spigot 112 as attached to a portion 113 of the rolling support structure 4. This portion 113 is fixed in that it does not rotate with the remainder of the rolling support structure 4. The spigot 112 may be fixed to the portion 113 or the spigot 112 may be removable from the portion 113.

The spigot 112 has a pair of opposed grooves 118, one of which opens towards the front of the vacuum cleaner 1 and one of which opens towards the rear of the vacuum cleaner 1. It can be seen that the grooves 118 are elongate in shape and extend down the side surface 114 of the spigot 112 and end on the top surface 116 of the spigot 112. These grooves 118 are positioned and sized to co-operate with a pair of projections, in the form of fins 120 which project from an inner surface 122 of the down duct 110 on the separating apparatus 10 These fins 120 can be seen best in FIGS. 14, 16*a* and 16*b*.

The fins 120 have a pair of opposed running surfaces 128 which are parallel to one another. The grooves 118 have a corresponding pair of angled running surfaces 130 which are parallel to each other but are arranged at a 19 degree angle to the longitudinal axis of the spigot 112. This angle may vary and may be from 10 degrees to 30 degrees.

Figure 15:
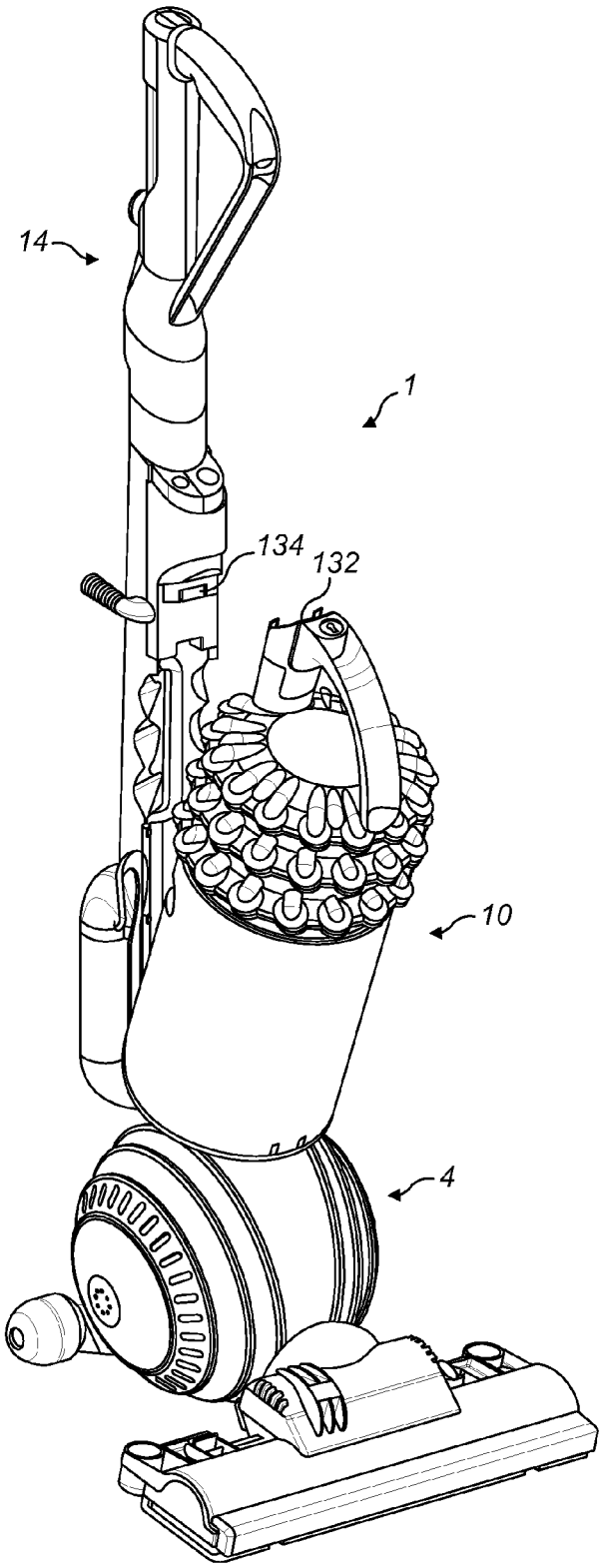
FIG. 15 is a front perspective view of the second embodiment, where the cyclonic separating apparatus is being docked onto the spigot.

The vacuum cleaner 1 is arranged such that when the cyclonic separating apparatus 10 is docked on the rolling support structure 4, the fins 120 are located within the grooves 118 thus ensuring that the separating apparatus 10 is in the correct orientation and position. FIG. 15 shows the separating apparatus 10 being docked onto the spigot 112. This docking is shown in section in FIGS. 16 and 17.

Figure 16A:
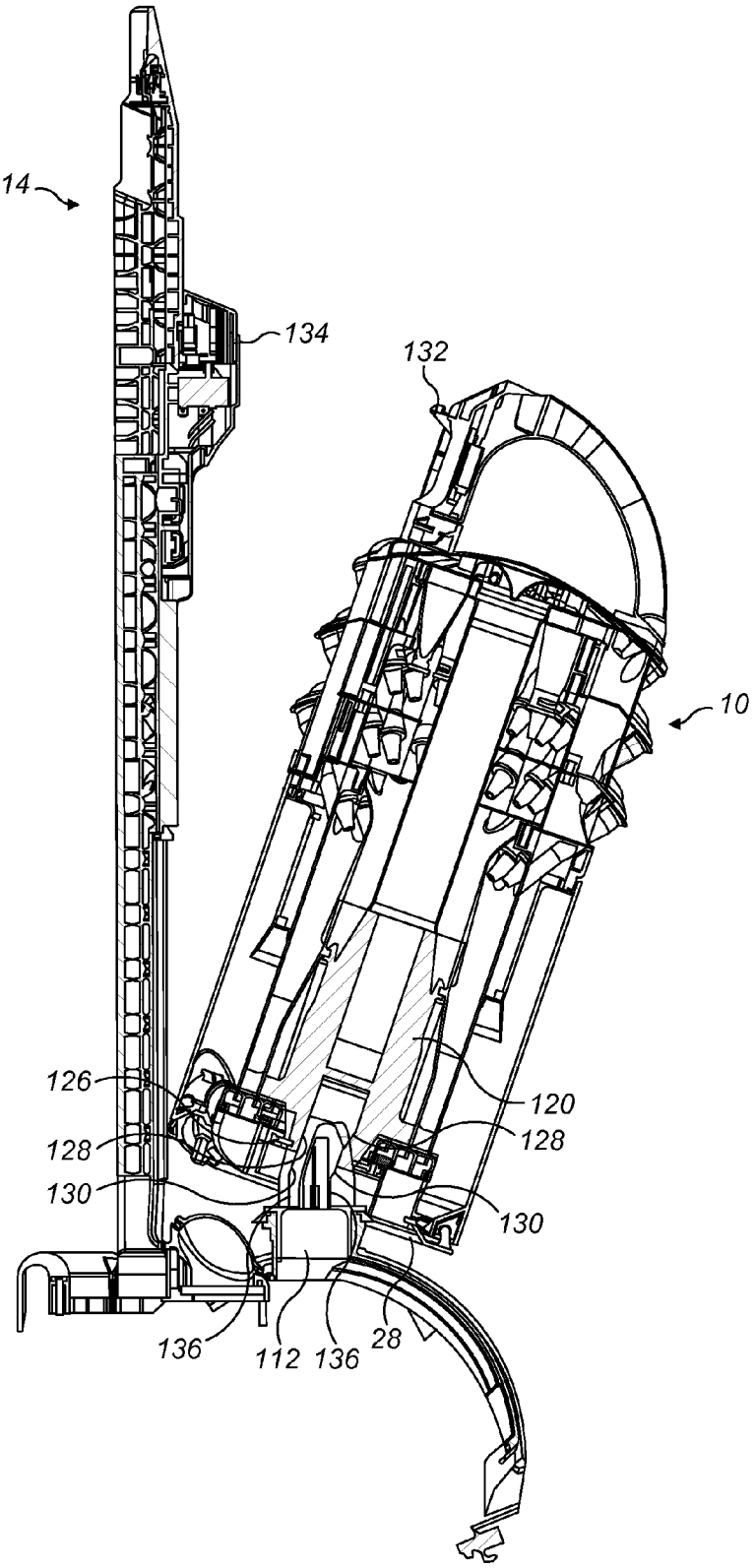
FIG. 16A is a section through the second embodiment where the cyclonic separating apparatus is being docked onto the spigot.
Figure 16B:
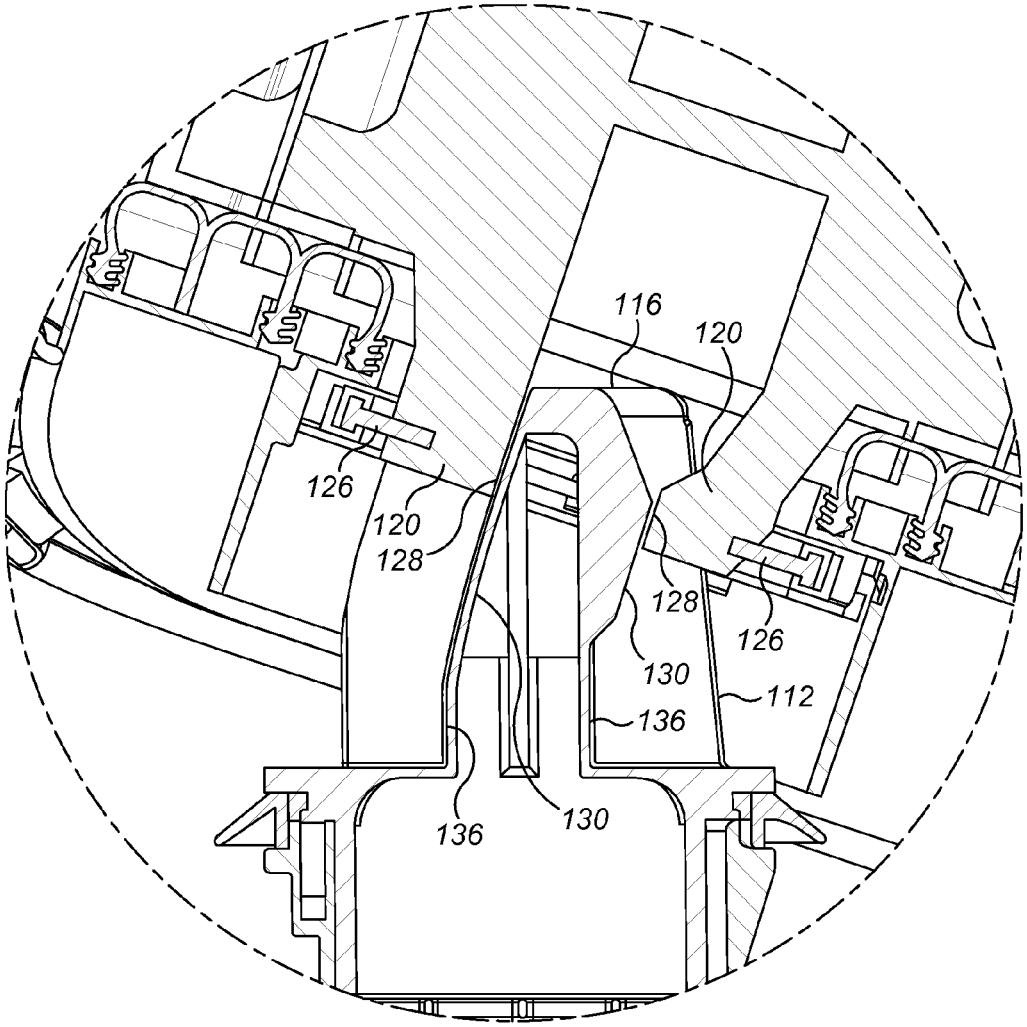
FIG. 16B is a close up view of the spigot shown in FIG. 16A.
Figure 17:
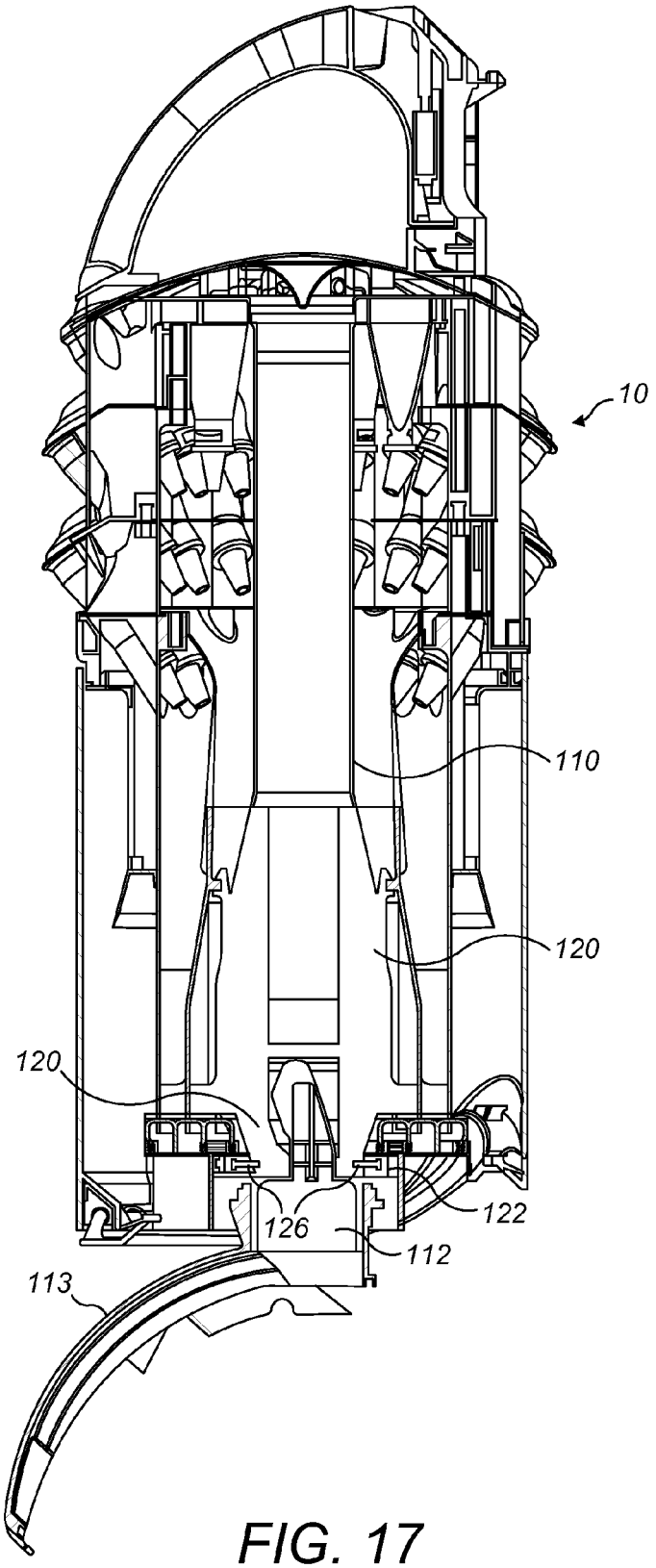
FIG. 17 is a section through the separating apparatus and spigot of the second embodiment, showing the separating apparatus docked fully on the spigot.
Figure 18:
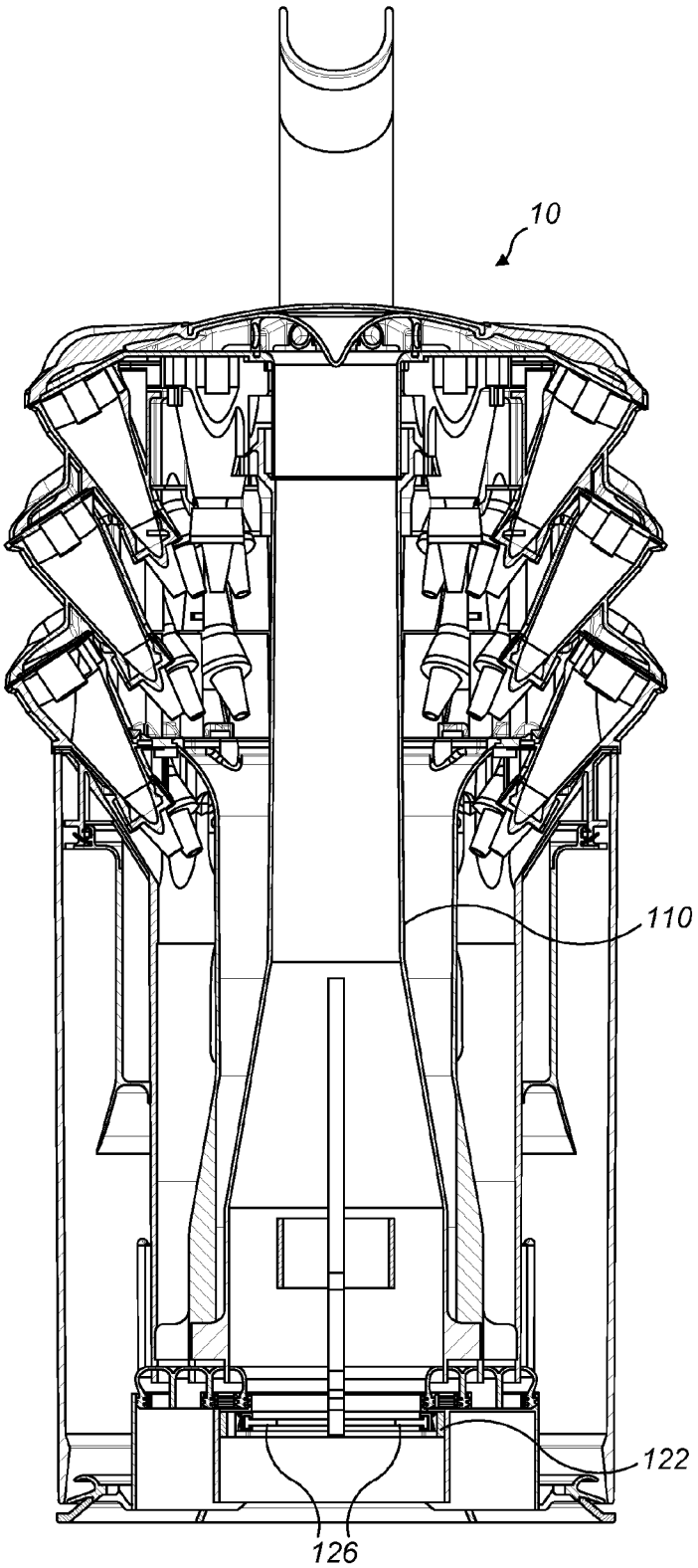
FIG. 18 is a section through the separating apparatus of the second embodiment showing the cleaning member.
Figure 19:
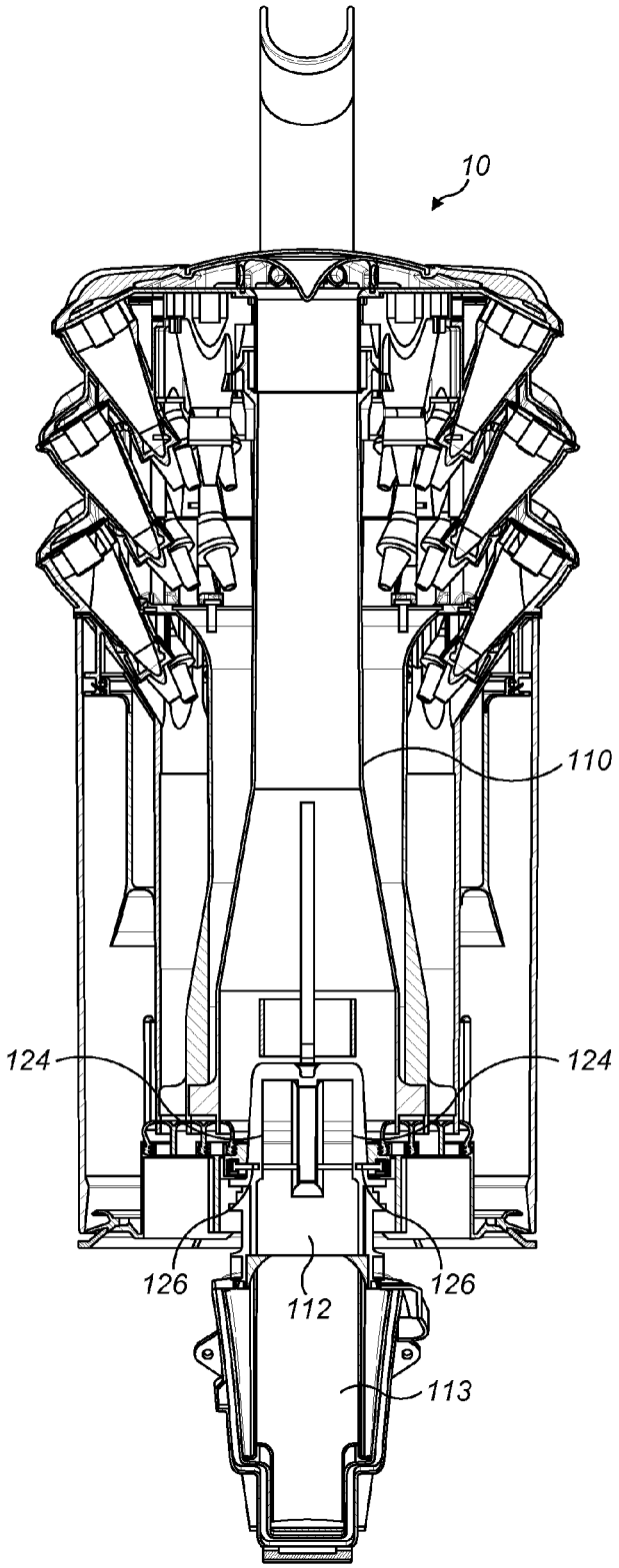
FIG. 19 is a section through the separating apparatus of the second embodiment showing the cleaning member and the spigot.
Figure 20A:
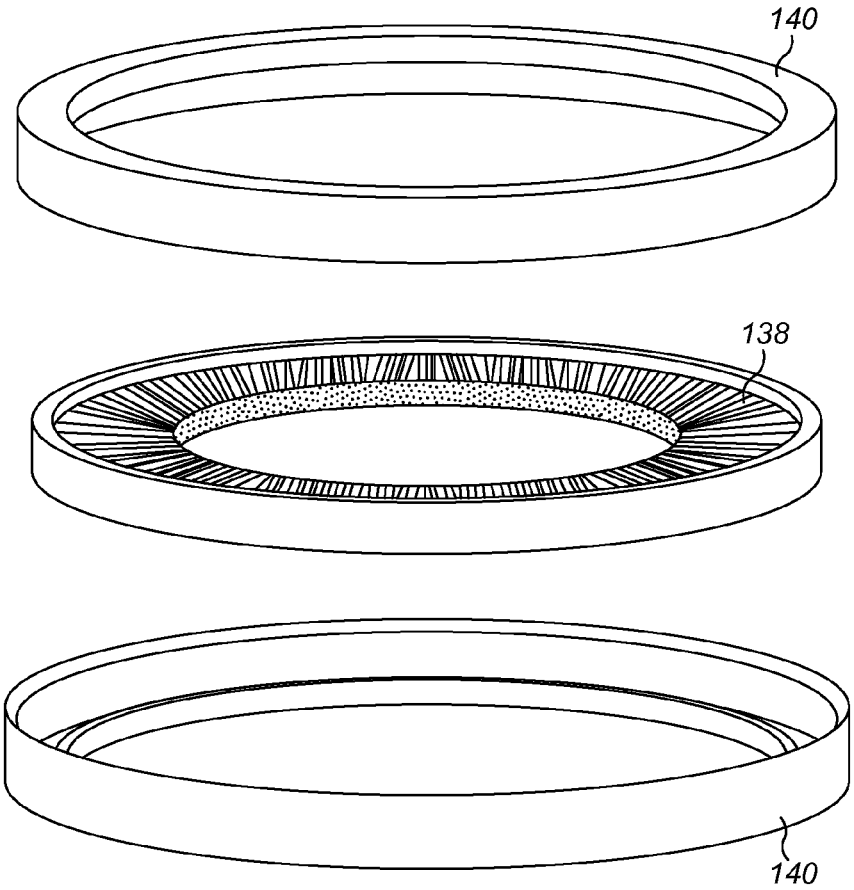
FIG. 20A is an exploded view of the cleaning member shown in FIGS. 14 and 16 to 19.
Figure 20B:
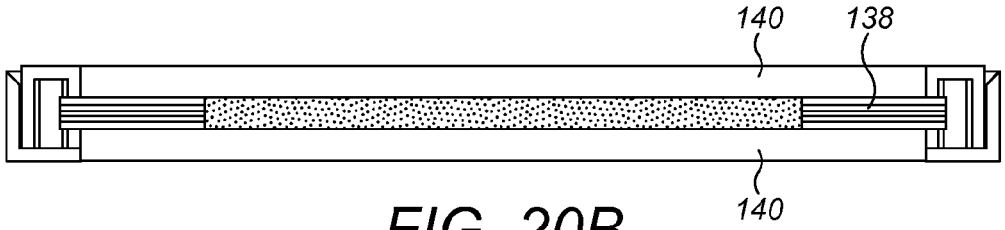
FIG. 20B is section through the cleaning member shown in FIG. 20A.
Figure 20C:
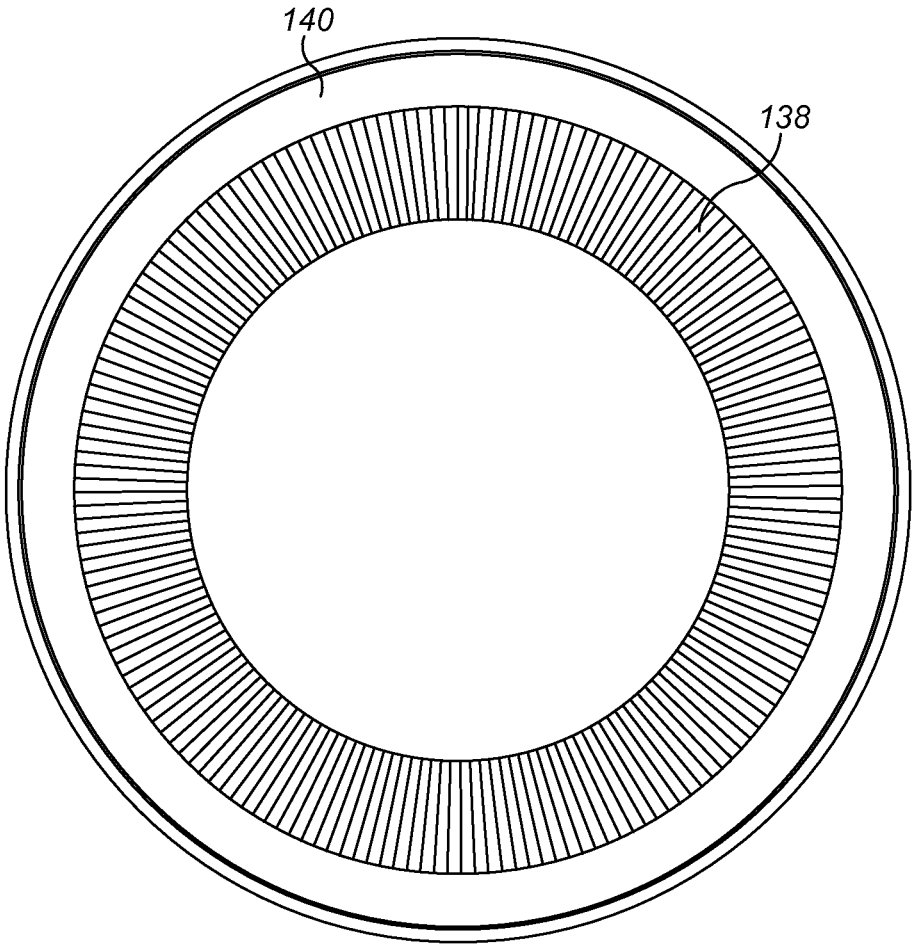
FIG. 20C is a top view of the cleaning member shown in FIGS. 20A and 20B.

In FIGS. 16A and B it can be seen that the separating apparatus 10 is brought down onto the spigot 112 such that the fins 120 engage within the grooves 118. As the fins 120 enter the grooves 118 the opposed running surfaces 128 of the fins 120 come into contact with and run along the angled running surfaces 130 of the grooves 118. This ensures that the separating apparatus 10 is pushed onto the spigot 112 correctly and at the desired angle until the separating apparatus 10 docks fully with the spigot 112. Once the separating apparatus 10 is fully docked with the spigot 112 the opposed running surfaces 128 contact the parallel docking surfaces 136 which are positioned below the angled running surfaces 130. These parallel docking surfaces are parallel with the longitudinal axis of the spigot 112. In order to firmly attach the separating apparatus 10 to the wand and handle assembly 14, the separating apparatus 10 has a locking catch 132 which engages with a corresponding attachment point 134 on the wand and handle assembly 14.

In FIGS. 13A to D it can be seen that the rear side 123 of the spigot 112 curves inwardly towards the top surface 116. This feature and the angled running surfaces 130 help to ensure that the separating apparatus 10 can be removed easily from the spigot 112 by pulling the separating apparatus 10 in an upward and forward direction. Without these measures there is a risk that the action of removing the separating apparatus 10 from the spigot 112 might cause the spigot 112 to rub on the bin base 28 of the separating apparatus 10, possibly causing the bin base 28 to open. The combination of the angled running surfaces 130 which restrict outward rotation of the separating apparatus 10 to 19 degrees and the curved rear side 123 of the spigot 112 are therefore advantageous.

Figure 13A:
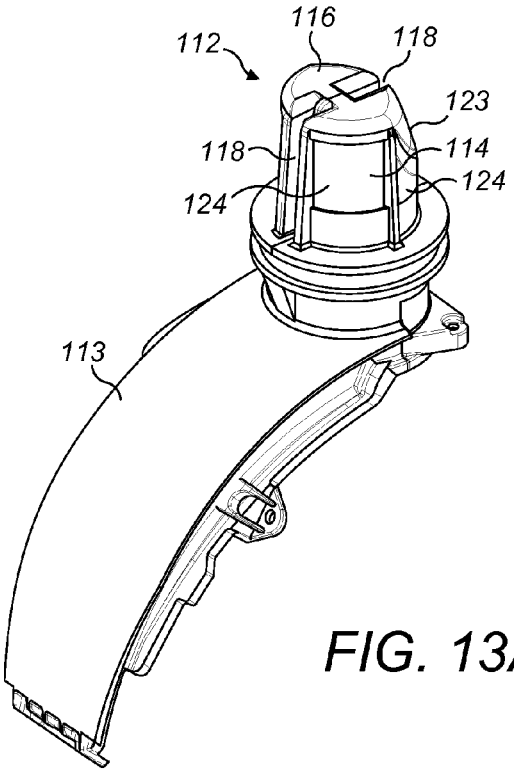
FIG. 13A is a perspective view of the spigot shown in FIG. 12.
Figure 13B:
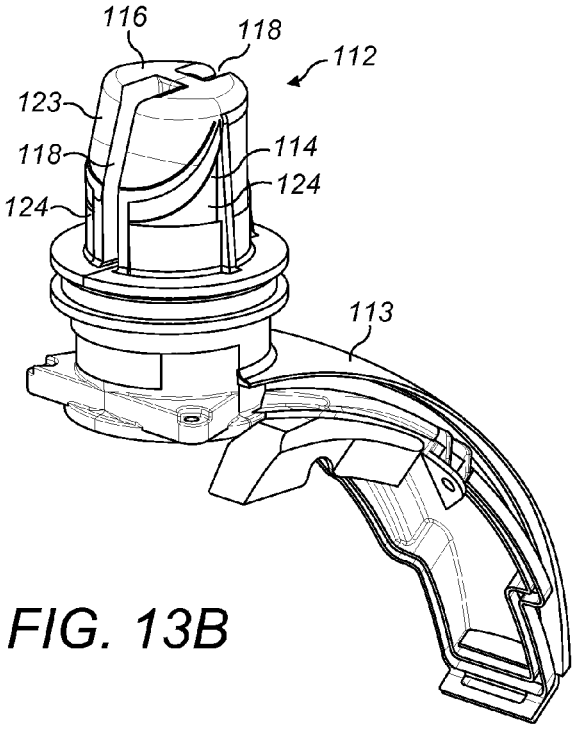
FIG. 13B is a rear perspective view of the spigot shown in FIG. 12.
Figure 13C:
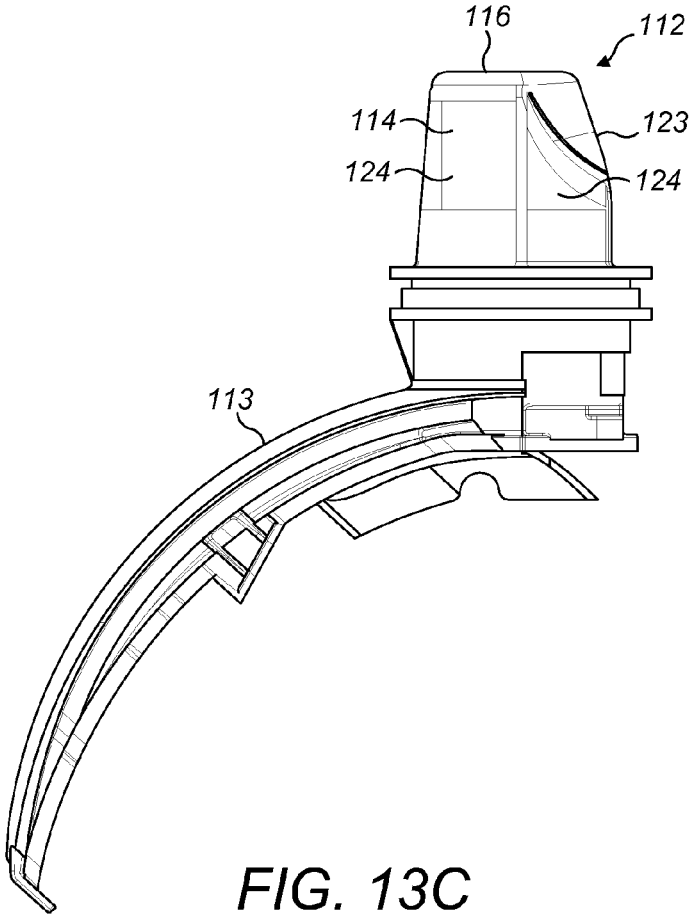
FIG. 13C is a side view of the spigot shown in FIG. 12.
Figure 13D:
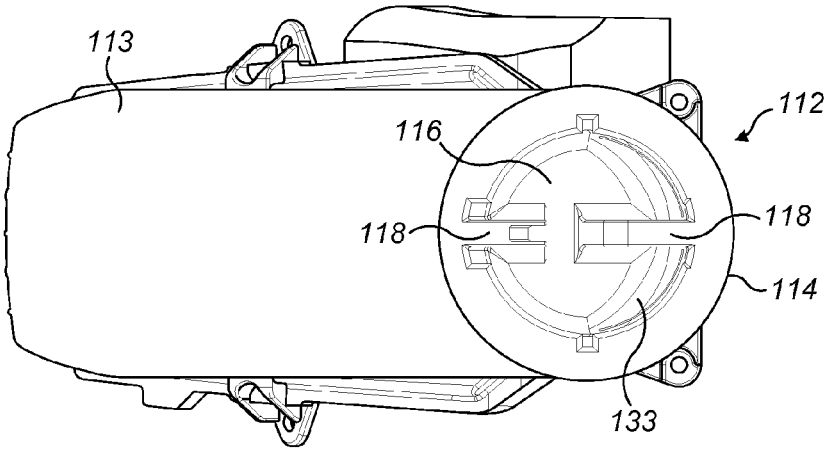
FIG. 13D is a top view of the spigot shown in FIG. 12.
Figure 14:
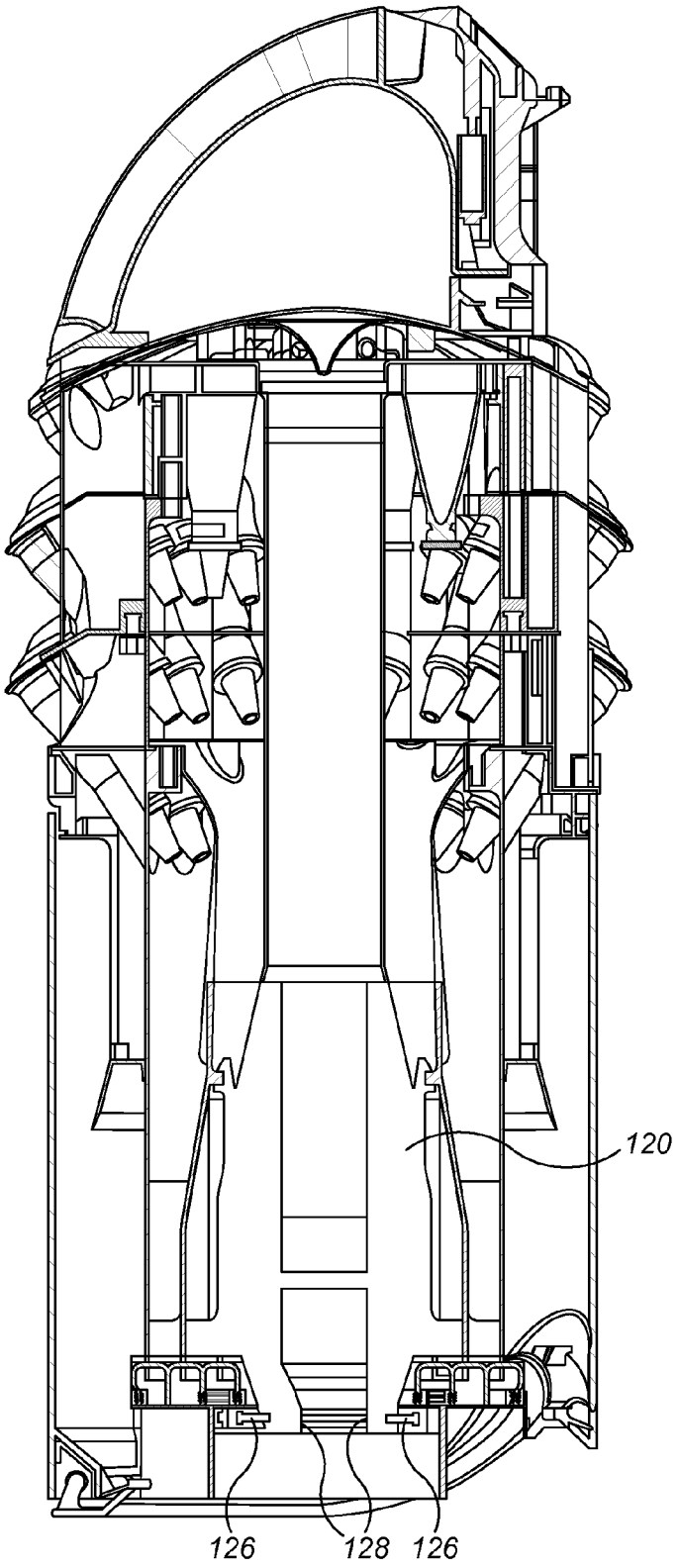
FIG. 14 is a section through the separating apparatus of the second embodiment.

As can be seen in FIGS. 12 to 13C the spigot 112 further comprises a plurality of mesh screens 124 through which air from the cyclonic separating apparatus 10 must pass before reaching the motor and fan unit 11. The mesh screens 124 are located on the side surface 114 of the spigot 112. In the embodiment shown there are 4 mesh screens 124 but there may be more or less screens. The mesh screens 124 which are located towards the front of the vacuum cleaner 1 are generally square or rectangular in shape whereas the mesh screens 124 which are located towards the rear of the vacuum cleaner 1 have a more irregular shape due to the curved rear side surface 123 of the spigot 112. In the embodiment shown there are no mesh screens on the top surface 116 of the spigot 112. In this regard the top surface 116 of the spigot 112 is closed to airflow.

The mesh screens 124 are formed from woven stainless steel threads. The mesh has apertures of 0.15 mm This mesh is therefore suitable for preventing particles which are greater than 150 microns from passing through it. The mesh screens 124 may however be formed from different materials and the apertures may be larger or smaller as desired. In the motor and fan unit 11 there may be components which are sensitive to blockage by dirt particles. For example if the stator and rotor of a motor are spaced at for example from 140 to 150 microns apart, it may be desirable to prevent dust particles of this size from reaching the motor. Smaller particles would pass through the gap without affecting the motor and larger particles would not be able to enter the gap. In such an embodiment it would therefore be desirable to ensure that the mesh 124 could prevent dust particles of from 140 to 160 microns from passing through it. What size of mesh aperture to choose will of course depend on the dimensions of the motor and fan and will depend on what type and size of dirt particle the motor and fan assembly 11 can handle without damage.

As can be seen in FIGS. 14, 16A and 16B to 20 the separating apparatus 10 further comprises a cleaning member 126 which is in the form of a ring shaped brush located such that the brush projects from the inner surface 122 of the down duct 110 into the down duct 110. The cleaning member 126 can be seen in more detail in FIGS. 20A to 20C. A ring of brush fibers 138 is sandwiched between two plastic rings 140 to form a unit which sits at the bottom end of the down duct 110. As the separating apparatus 10 is docked and undocked from the spigot 112, the brush fibers 138 sweep over the mesh screens 124, cleaning away any dirt which has built up on the outside of the mesh screens 124. In this way the mesh screens 124 are kept clean. The cleaning member 126 is preferably fixed against rotational movement so that it does not rotate as the cyclone pack 10 is docked or undocked from the spigot 112. The cleaning member 126 may however be arranged such that it has some degree of lateral flexibility. The brush fibers are made from a plastics material. The location of the cleaning member 126 within the separating apparatus 10 may vary as long as it is positioned such that the mesh screens 124 are cleaned as the separating apparatus 10 is either docked with the spigot 112 or removed from the spigot 112.

The invention claimed is:

1. A cleaning appliance comprising a cyclonic separating apparatus for separating dust from an airflow, the cyclonic separating apparatus having at least one cyclone, a support structure housing a motor and fan assembly for creating an airflow through the separating apparatus, the cyclonic separating apparatus comprising a duct which directs air from the at least one cyclone towards the support structure, the support structure or duct comprising at least one mesh screen through which air from the cyclonic separating apparatus must pass before reaching the motor and fan assembly, wherein the cyclonic separating apparatus comprises a cleaner located in the duct that is configured to sweep or wipe the at least one mesh screen.

2. The cleaning appliance of claim 1, wherein the mesh screen has apertures of from 140 microns to 160 microns.

3. The cleaning appliance of claim 1, wherein the mesh screen is a woven screen.

4. The cleaning appliance of claim 1, wherein the mesh screen is formed from stainless steel.

5. The cleaning appliance of claim 1, wherein the open area of the mesh screen is from 40% to 65%.

6. The cleaning appliance of claim 5, wherein the open area of the mesh screen as at least the same area as the area of the inlet of the motor.

7. The cleaning appliance of claim 1, comprising a spigot which projects from the support structure and in use is docked within the duct.

8. The cleaning appliance of claim 7, wherein the spigot comprises at least one groove and the duct comprises at least one projection, the appliance being arranged such that when the cyclonic separating apparatus is docked on the support structure, the projection is located within the groove.

9. The cleaning appliance of claim 7, wherein a top surface of the spigot is impermeable to airflow.

10. The cleaning appliance of claim 1, wherein the at least one mesh screen is located on the spigot.

11. The cleaning appliance of claim 10, wherein the spigot comprises a plurality of mesh screens.

12. The cleaning appliance of claim 1, wherein the at least one mesh screen is located on a side surface of the spigot.

13. The cleaning appliance of claim 1, comprising a spigot which projects from the support structure and in use is docked within the duct, wherein the cleaner comprises a cleaning member located in the duct which sweeps or wipes the at least one mesh screen as the cyclonic separating apparatus is one or both of docked onto the spigot and undocked from the spigot.

14. The cleaning appliance of claim 1, wherein the cleaner is circular in shape and is located such that it projects into the duct.

15. The cleaning appliance of claim 1, wherein the cleaner is fixed against rotational movement.

16. The cleaning appliance of claim 1, wherein the cleaner comprises a brush.

17. The cleaning appliance of claim 1, wherein the support structure is a rolling support structure for allowing the cleaning appliance to be maneuvered across a surface to be cleaned.

18. A cleaning appliance comprising a cyclonic separating apparatus for separating dust from an airflow, the cyclonic separating apparatus having at least one cyclone, a support structure housing a motor and fan assembly for creating an airflow through the separating apparatus, the cyclonic separating apparatus comprising a duct which directs air from the at least one cyclone towards the support structure, the support structure comprising a spigot which projects from the support structure and in use is docked within the duct, the spigot having at least one aperture through which the airflow can pass and at least one groove, and the duct having at least one projection, the appliance being arranged such that when the cyclonic separating apparatus is docked on the support structure, the projection is located within the groove.

19. The cleaning appliance of claim 18, wherein the spigot comprises a pair of opposed grooves and the duct comprises a pair of opposed projections.

20. The cleaning appliance of claim 18, wherein the spigot is generally cylindrical in shape.

21. The cleaning appliance of claim 18, wherein a portion of a side surface of the spigot is curved towards a top surface of the spigot.

22. The cleaning appliance of claim 18, wherein a top surface of the spigot is impermeable to airflow.

23. The cleaning appliance of claim 18, wherein the at least one aperture is covered by at least one mesh screen.

24. A cleaning appliance comprising a cyclonic separating apparatus for separating dust from an airflow, the cyclonic separating apparatus having at least one cyclone, a support structure housing a motor and fan assembly for creating an airflow through the separating apparatus, the cyclonic separating apparatus comprising a duct which directs air from the at least one cyclone towards the support structure, the support structure comprising a spigot which projects from the support structure and in use is docked within the duct, a portion of the spigot that is docked within the duct having a side surface comprising at least one aperture through which the airflow can pass, and a closed distal end which is impermeable to airflow.

25. The cleaning appliance of claim 24, wherein the at least one aperture is covered by at least one mesh screen.

* * * * *